US010850469B2

(12) United States Patent
Osterhout

(10) Patent No.: US 10,850,469 B2
(45) Date of Patent: Dec. 1, 2020

(54) BOX FORMING MACHINE

(71) Applicant: Packsize LLC, Salt Lake City, UT (US)

(72) Inventor: Ryan Osterhout, West Haven, UT (US)

(73) Assignee: Packsize LLC, Salt Lake City, UT (US)

( * ) Notice: Subject to any disclaimer, the term of this patent is extended or adjusted under 35 U.S.C. 154(b) by 172 days.

(21) Appl. No.: 15/616,688

(22) Filed: Jun. 7, 2017

(65) Prior Publication Data

US 2017/0361560 A1 Dec. 21, 2017

Related U.S. Application Data

(60) Provisional application No. 62/351,127, filed on Jun. 16, 2016, provisional application No. 62/425,457, filed on Nov. 22, 2016.

(51) Int. Cl.
*B31B 50/00* (2017.01)
*B31B 50/04* (2017.01)
(Continued)

(52) U.S. Cl.
CPC ..... *B31B 50/07* (2017.08); *B31B 50/066* (2017.08); *B31B 50/262* (2017.08); *B31B 50/52* (2017.08);
(Continued)

(58) Field of Classification Search
CPC ..... B31B 50/00; B31B 50/262; B31B 50/52; B31B 50/62; B31F 1/0006; B31F 1/0029;
(Continued)

(56) References Cited

U.S. PATENT DOCUMENTS 2,077,428 A 4/1937 Robert
2,083,351 A * 6/1937 Sidebotham ..... B31F 1/08 493/55
(Continued)

FOREIGN PATENT DOCUMENTS

CN 2164350 5/1994
CN 1191833 9/1998
(Continued)

OTHER PUBLICATIONS

International Search Report and Written Opinion for application No. PCT/US2017/036603 dated Oct. 27, 2017.
(Continued)

*Primary Examiner* — Thanh K Truong
*Assistant Examiner* — Patrick B Fry
(74) *Attorney, Agent, or Firm* — Workman Nydegger

(57) ABSTRACT

A box forming machine includes a converter assembly, a fold assembly, and an attachment assembly. The converter assembly converts sheet material into a box template. The fold assembly engages a first end of the box template and moves the first end of the box template to a predetermined position. The attachment assembly engages a second end of the box template and moves the second end of the box template toward and into engagement with the first end of the box template to attach the first and second ends of the box template together.

44 Claims, 16 Drawing Sheets

(51) Int. Cl.

| | |
|---|---|
| ***B31B 50/06*** | (2017.01) |
| ***B31B 50/07*** | (2017.01) |
| ***B31B 50/16*** | (2017.01) |
| ***B31B 50/25*** | (2017.01) |
| ***B31B 50/26*** | (2017.01) |
| ***B31B 50/52*** | (2017.01) |
| ***B31B 50/62*** | (2017.01) |
| ***B31B 50/81*** | (2017.01) |
| ***B31B 70/14*** | (2017.01) |
| ***B31B 70/16*** | (2017.01) |
| *B31B 110/35* | (2017.01) |
| *B31B 120/30* | (2017.01) |
| *B31B 100/00* | (2017.01) |
| *B31B 70/00* | (2017.01) |
| *B31B 110/30* | (2017.01) |

(52) U.S. Cl.

CPC ..... *B31B 50/624* (2017.08); *B31B 50/81* (2017.08); *B31B 50/006* (2017.08); *B31B 50/042* (2017.08); *B31B 50/16* (2017.08); *B31B 50/25* (2017.08); *B31B 50/8122* (2017.08); *B31B 70/14* (2017.08); *B31B 70/16* (2017.08); *B31B 70/25* (2017.08); *B31B 2100/002* (2017.08); *B31B 2110/30* (2017.08); *B31B 2110/35* (2017.08); *B31B 2120/302* (2017.08)

(58) Field of Classification Search

CPC ..... B65B 5/024; B65H 2701/1764; B65H 2701/1766

USPC ..... 493/51, 52, 127, 162, 183

See application file for complete search history.

(56) References Cited

U.S. PATENT DOCUMENTS 2,181,117 A 11/1939 Brenn
2,256,082 A 9/1941 Feurt
2,449,663 A 9/1948 Marcalus
2,609,736 A * 9/1952 Montgomery ..... B31B 50/00 493/450
2,631,509 A 3/1953 Whytlaw
2,679,195 A 5/1954 Whytlaw
2,699,711 A 1/1955 Mobley
2,798,582 A 7/1957 Monroe
3,057,267 A 10/1962 Johnson, Jr.
3,096,692 A 7/1963 Crathern et al.
3,105,419 A 10/1963 La Bombard
3,108,515 A 10/1963 Stohlquist
3,153,991 A 10/1964 Goodrich
3,285,145 A 11/1966 Lieberman
3,303,759 A 2/1967 Burke
3,308,723 A 3/1967 Bergh, Jr.
3,418,893 A 12/1968 Stohlquist
3,469,508 A 9/1969 Klapp
3,511,496 A 5/1970 Zoglmann
3,566,755 A * 3/1971 Smith ..... B65B 5/024 493/162
3,611,884 A 10/1971 Hottendorf
3,618,479 A * 11/1971 Shields ..... B31B 50/00 493/144
3,628,408 A 12/1971 Rod et al.
3,646,418 A 2/1972 Sterns et al.
3,743,154 A 7/1973 Brewitz
3,763,750 A 10/1973 Reichert
3,776,109 A * 12/1973 Clark ..... B31B 50/00 493/121
3,803,798 A 4/1974 Clancy
3,804,514 A 4/1974 Jasinski
3,807,726 A 4/1974 Hope
3,882,764 A 5/1975 Johnson
3,891,203 A 6/1975 Schiff
3,912,389 A 10/1975 Miyamoto
3,913,464 A * 10/1975 Flaum ..... B31B 50/00 493/142
3,949,654 A 4/1976 Stehlin
4,033,217 A 7/1977 Flaum et al.
4,044,658 A 8/1977 Mitchard
4,052,048 A 10/1977 Shirasaka
4,056,025 A 11/1977 Rubel
4,094,451 A 6/1978 Wescoat
4,121,506 A 10/1978 Van Grouw
4,123,966 A * 11/1978 Buschor ..... B31B 50/00 493/127
4,164,171 A * 8/1979 Meyers ..... B31B 50/00 198/404
4,173,106 A 11/1979 Garcia et al.
4,191,467 A 3/1980 Schieck
4,224,847 A 9/1980 Tokuno
4,261,239 A 4/1981 Toboshi et al.
4,264,200 A 4/1981 Tickner
4,295,841 A * 10/1981 Ward, Jr. ..... B31B 50/00 493/179
4,320,960 A 3/1982 Ward et al.
4,368,052 A * 1/1983 Bitsky ..... B31B 50/00 493/130
4,373,412 A 2/1983 Gerber et al.
4,375,970 A 3/1983 Murphy
4,449,349 A 5/1984 Roth
4,487,596 A 12/1984 Livens et al.
4,563,169 A 1/1986 Virta et al.
D286,044 S 10/1986 Kando
4,638,696 A 1/1987 Urwyler
4,695,006 A 9/1987 Pool
4,714,946 A 12/1987 Bajgert
4,743,131 A 5/1988 Atwell
4,749,295 A 6/1988 Bankier
4,773,781 A 9/1988 Bankier
4,838,468 A 6/1989 Lesse
4,847,632 A 7/1989 Norris
4,878,521 A 11/1989 Fredrickson
4,887,412 A 12/1989 Takamura
4,923,188 A 5/1990 Neir
4,932,930 A * 6/1990 Coalier ..... B31B 50/00 493/128
4,979,932 A 12/1990 Burnside
5,005,816 A 4/1991 Stemmler
5,039,242 A 8/1991 Johnson
5,046,716 A 9/1991 Lippold
5,058,872 A 10/1991 Gladow
5,072,641 A 12/1991 Urban et al.
5,081,487 A 1/1992 Hoyer
5,090,281 A 2/1992 Paulson
5,111,252 A 5/1992 Hamada
5,118,093 A 6/1992 Makiura
5,120,279 A 6/1992 Adami
5,123,890 A 6/1992 Green
5,123,894 A 6/1992 Bergeman
5,137,172 A 8/1992 Wagner
5,137,174 A 8/1992 Bell
5,197,366 A 3/1993 Paulson
5,240,243 A 8/1993 Gompertz
5,241,353 A 8/1993 Maeshima
5,263,785 A 11/1993 Negoro
D344,751 S 3/1994 Keong
5,321,464 A 6/1994 Jessen
2,353,419 A 7/1994 Smithson
5,335,777 A 8/1994 Murphy
5,358,345 A 10/1994 Damitio
5,369,939 A 12/1994 Moen et al.
5,375,390 A 12/1994 Frigo et al.
5,411,252 A 5/1995 Lowell
5,584,633 A 12/1996 Scharer
5,586,758 A 12/1996 Kimura
5,624,369 A 4/1997 Bidlack et al.
5,671,593 A 9/1997 Ginestra et al.
5,716,313 A 2/1998 Sigrist et al.
5,727,725 A 3/1998 Paskvich
5,836,498 A 11/1998 Turek
5,902,223 A 5/1999 Simmons
5,927,702 A 7/1999 Ishii

(56) References Cited

U.S. PATENT DOCUMENTS

| | | | | |
|---|---|---|---|---|
| 5,941,451 | A | 8/1999 | Dexter | |
| 5,964,686 | A | 12/1999 | Bidlack et al. | |
| 6,000,525 | A | 12/1999 | Frulio | |
| 6,071,223 | A | 6/2000 | Reider et al. | |
| 6,164,045 | A | 12/2000 | Focke | |
| 6,189,933 | B1 | 2/2001 | Felderman | |
| 6,321,650 | B1 | 11/2001 | Ogawa | |
| 6,397,557 | B1 | 6/2002 | Bassissi | |
| 6,428,000 | B1 | 8/2002 | Hara | |
| 6,471,154 | B1 | 10/2002 | Zsolt | |
| 6,553,207 | B2 | 4/2003 | Tsusaka | |
| 6,568,865 | B1 | 5/2003 | Fujioka | |
| 6,673,001 | B2 | 1/2004 | Toth | |
| 6,830,328 | B2 | 12/2004 | Cuyler, Jr. | |
| 6,837,135 | B2 | 1/2005 | Michalski | |
| 6,840,898 | B2 | 1/2005 | Pettersson | |
| 6,910,997 | B1 | 6/2005 | Yampolsky et al. | |
| 6,968,859 | B1 | 11/2005 | Nagano et al. | |
| 7,100,811 | B2 | 9/2006 | Pettersson | |
| 7,121,543 | B2 | 10/2006 | Fujioka | |
| 7,237,969 | B2 | 7/2007 | Bartman | |
| 7,637,857 | B2 | 12/2009 | Coullery et al. | |
| 7,641,190 | B2 | 1/2010 | Hara | |
| 7,647,752 | B2 | 1/2010 | Magnell | |
| 7,648,451 | B2 | 1/2010 | Calugi | |
| 7,648,596 | B2 | 1/2010 | Sharpe et al. | |
| 7,690,099 | B2 | 4/2010 | Bapst et al. | |
| 7,997,578 | B2 | 8/2011 | Saito | |
| D703,246 | S | 4/2014 | Pettersson et al. | |
| 9,120,284 | B2 | 9/2015 | Capoia | |
| 9,199,794 | B2 * | 12/2015 | Nadachi | B65H 5/224 |
| 9,329,565 | B2 | 5/2016 | Osaki | |
| 9,352,526 | B2 | 5/2016 | Pettersson et al. | |
| 9,969,142 | B2 | 5/2018 | Pettersson et al. | |
| 10,093,438 | B2 | 10/2018 | Pettersson | |
| 2002/0017754 | A1 | 2/2002 | Kang | |
| 2002/0066683 | A1 | 6/2002 | Sanders | |
| 2002/0091050 | A1 | 7/2002 | Bacciottini et al. | |
| 2002/0115548 | A1 | 8/2002 | Lin et al. | |
| 2002/0125712 | A1 | 9/2002 | Felderman | |
| 2002/0139890 | A1 | 10/2002 | Toth | |
| 2003/0102244 | A1 | 6/2003 | Sanders | |
| 2004/0060264 | A1 | 4/2004 | Miller | |
| 2004/0082453 | A1 | 4/2004 | Pettersson | |
| 2004/0092374 | A1 | 5/2004 | Chiu-Fu | |
| 2004/0261365 | A1 | 12/2004 | White | |
| 2005/0079965 | A1 | 4/2005 | Moshier et al. | |
| 2005/0103923 | A1 | 5/2005 | Pettersson | |
| 2005/0215409 | A1 | 9/2005 | Abramson et al. | |
| 2005/0280202 | A1 | 12/2005 | Vila | |
| 2006/0180991 | A1 | 8/2006 | Nakahata et al. | |
| 2006/0181008 | A1 | 8/2006 | Van Gerven | |
| 2007/0079575 | A1 | 4/2007 | Monti | |
| 2007/0228119 | A1 | 10/2007 | Barner | |
| 2007/0287623 | A1 | 12/2007 | Carlson | |
| 2007/0289253 | A1 | 12/2007 | Miller | |
| 2008/0020916 | A1 | 1/2008 | Magnell | |
| 2008/0066632 | A1 | 3/2008 | Raueiser | |
| 2008/0115641 | A1 | 5/2008 | Freyburger et al. | |
| 2008/0148917 | A1 | 6/2008 | Pettersson | |
| 2008/0300120 | A1 * | 12/2008 | Sato | B31F 1/10 493/69 |
| 2009/0062098 | A1 | 3/2009 | Inoue et al. | |
| 2009/0178528 | A1 | 7/2009 | Adami | |
| 2009/0199527 | A1 | 8/2009 | Wehr et al. | |
| 2010/0041534 | A1 | 2/2010 | Harding | |
| 2010/0111584 | A1 | 5/2010 | Shiohara | |
| 2011/0026999 | A1 | 2/2011 | Kohira | |
| 2011/0092351 | A1 * | 4/2011 | Hatano | B31B 50/00 493/162 |
| 2011/0099782 | A1 | 5/2011 | Schonberger et al. | |
| 2011/0110749 | A1 | 5/2011 | Carter et al. | |
| 2011/0171002 | A1 | 7/2011 | Pettersson | |
| 2011/0229191 | A1 | 9/2011 | Nomi | |
| 2011/0230325 | A1 | 9/2011 | Harding et al. | |
| 2011/0319242 | A1 | 12/2011 | Pettersson | |
| 2012/0021884 | A1 | 1/2012 | Musha | |
| 2012/0122640 | A1 | 5/2012 | Pazdernik et al. | |
| 2012/0129670 | A1 | 5/2012 | Pettersson et al. | |
| 2012/0139670 | A1 | 6/2012 | Yamagata | |
| 2012/0142512 | A1 | 6/2012 | Keller | |
| 2013/0000252 | A1 | 1/2013 | Pettersson et al. | |
| 2013/0045847 | A1 | 2/2013 | Capoia | |
| 2013/0130877 | A1 | 5/2013 | Su | |
| 2013/0210597 | A1 | 8/2013 | Pettersson | |
| 2013/0333538 | A1 | 12/2013 | Long et al. | |
| 2014/0091511 | A1 | 4/2014 | Martin | |
| 2014/0101929 | A1 | 4/2014 | Kim | |
| 2014/0315701 | A1 | 10/2014 | Pettersson | |
| 2014/0336026 | A1 | 11/2014 | Pettersson | |
| 2014/0357463 | A1 | 12/2014 | Kojima | |
| 2015/0018189 | A1 | 1/2015 | Pettersson et al. | |
| 2015/0019387 | A1 | 1/2015 | Pettersson | |
| 2015/0053349 | A1 | 2/2015 | Mori et al. | |
| 2015/0148210 | A1 | 5/2015 | Robert | |
| 2015/0224731 | A1 | 8/2015 | Ponti | |
| 2015/0273897 | A1 | 10/2015 | Kato | |
| 2015/0360433 | A1 | 12/2015 | Feijen et al. | |
| 2015/0360801 | A1 | 12/2015 | Sytema | |
| 2016/0001441 | A1 | 1/2016 | Osterhout et al. | |
| 2016/0122044 | A1 | 5/2016 | Evers | |
| 2016/0184142 | A1 | 6/2016 | Vanvalkenburgh et al. | |
| 2016/0185475 | A1 | 6/2016 | Pettersson et al. | |
| 2016/0340067 | A1 | 11/2016 | Winkler et al. | |
| 2017/0355166 | A1 | 12/2017 | Jonker | |
| 2018/0178476 | A1 | 6/2018 | Pettersson et al. | |
| 2018/0201465 | A1 | 7/2018 | Osterhout | |
| 2018/0265228 | A1 | 9/2018 | Hagestedt | |

FOREIGN PATENT DOCUMENTS

| | | | |
|---|---|---|---|
| CN | 1366487 | | 8/2002 |
| CN | 1876361 | | 12/2006 |
| CN | 102371705 | | 3/2012 |
| CN | 202412794 | | 9/2012 |
| CN | 102753442 | | 10/2012 |
| CN | 104169073 | | 11/2014 |
| CN | 104185538 | | 12/2014 |
| CN | 204773785 | | 11/2015 |
| DE | 1082227 | | 5/1960 |
| DE | 1212854 | | 3/1966 |
| DE | 3825506 | A1 | 2/1990 |
| DE | 19541061 | | 11/1996 |
| DE | 10355544 | | 6/2005 |
| DE | 102005063193 | | 7/2007 |
| DE | 102008035278 | | 4/2010 |
| EP | 0030366 | | 6/1981 |
| EP | 0234228 | A2 | 9/1987 |
| EP | 0359005 | | 3/1990 |
| EP | 650827 | | 5/1995 |
| EP | 889779 | | 1/1999 |
| EP | 903219 | | 3/1999 |
| EP | 1065162 | | 1/2001 |
| EP | 1223107 | | 7/2002 |
| EP | 1373112 | | 1/2004 |
| EP | 1997736 | | 12/2008 |
| EP | 1497049 | | 3/2010 |
| EP | 2228206 | | 9/2010 |
| EP | 3231594 | A1 | 10/2017 |
| FR | 428967 | | 9/1911 |
| FR | 1020458 | | 2/1953 |
| FR | 1592372 | | 5/1970 |
| FR | 2721301 | | 12/1995 |
| FR | 2770445 | | 5/1999 |
| FR | 2808722 | | 11/2001 |
| FR | 2976561 | | 12/2012 |
| GB | 0166622 | | 7/1921 |
| GB | 983946 | | 2/1965 |
| GB | 1362060 | | 7/1974 |
| JP | S5557984 | | 4/1980 |
| JP | S5689937 | | 7/1981 |
| JP | S59176836 | | 10/1984 |
| JP | S61118720 | | 7/1986 |
| JP | 8238690 | | 9/1996 |

(56) References Cited

FOREIGN PATENT DOCUMENTS

| | | | |
|---|---|---|---|
| JP | H08333036 | | 12/1996 |
| JP | 2000323324 | | 11/2000 |
| JP | 2003079446 | | 3/2003 |
| JP | 2005067019 | | 3/2005 |
| JP | 2005219798 | | 8/2005 |
| JP | 2006289914 | | 10/2006 |
| JP | 2008254789 | | 10/2008 |
| JP | 2009132049 | | 6/2009 |
| JP | 2011520674 | | 7/2011 |
| JP | 2011230385 | | 11/2011 |
| RU | 2015030 | | 6/1994 |
| RU | 2004136918 | | 5/2006 |
| RU | 2398674 | | 9/2010 |
| SE | 450829 | | 8/1987 |
| SE | 0450829 | B | 8/1987 |
| SU | 1054863 | | 11/1983 |
| SU | 1718783 | | 3/1992 |
| WO | 199614773 | | 6/1996 |
| WO | 97/31773 | A2 | 9/1997 |
| WO | 1999/017923 | | 4/1999 |
| WO | 02/79062 | A1 | 10/2002 |
| WO | 3089163 | | 10/2003 |
| WO | 2010091043 | | 8/2010 |
| WO | 2011007237 | | 1/2011 |
| WO | 2011100078 | | 8/2011 |
| WO | 2011135433 | | 11/2011 |
| WO | 2012003167 | | 1/2012 |
| WO | 2013071073 | | 5/2013 |
| WO | 2013071080 | | 7/2013 |
| WO | 2013106180 | | 7/2013 |
| WO | 2013114057 | | 8/2013 |
| WO | 2014/117817 | A1 | 8/2014 |
| WO | 2016/176271 | | 11/2016 |
| WO | 2017203401 | | 11/2017 |
| WO | 2017218296 | | 12/2017 |
| WO | 2017218297 | | 12/2017 |

OTHER PUBLICATIONS

International Search Report and Written Opinion for application No. PCT/US2010/022983 dated Apr. 13, 2010.
International Search Report and Wirtten Opinion for application No. PCT/US2012/070719 dated Feb. 25, 2013.
International Search Report and Written Opininon for application No. PCT/US2017/036606 dated Oct. 24, 2017.
International Search Report for PCT/US2011/042096 dated Oct. 28, 2011.
European Search Report for EP80107577.1 dated Feb. 3, 1981.
European Search Report for EP89115688.7 dated Feb. 11, 1989.
International Search Report and Written Opinion for PCT/US2012/064414 dated Jan. 25, 2013.
International Search Report and Written Opinion for PCT/US2012/064403 dated Apr. 8, 2013.
European Search Report for EP12848321 dated Jul. 1, 2015.
European Search Report for EP12865028 dated Jul. 7, 2015.
European Search Report for EP16169030 dated Dec. 16, 2016, dated Jan. 5, 2017.
European Search Report for application No. EP17175751 dated Sep. 22, 2017.
Japanese Office Action for application No. 2017-000038 dated Sep. 22, 2017.
U.S. Appl. No. 13/147,787, Aug. 27, 2014, Office Action.
U.S. Appl. No. 13/147,787, Apr. 17, 2015, Final Office Action.
U.S. Appl. No. 13/147,787, Sep. 30, 2015, Office Action.
U.S. Appl. No. 13/805,602, Dec. 2, 2015, Office Action.
U.S. Appl. No. 13/147,787, Feb. 16, 2016, Final Office Action.
U.S. Appl. No. 13/147,787, Oct. 28, 2016, Office Action.
U.S. Appl. No. 13/147,787, Mar. 7, 2017, Final Office Action.
U.S. Appl. No. 13/147,787, Jun. 26, 2017, Notice of Allowance.
U.S. Appl. No. 29/419,922, Aug. 6, 2013, Office Action.
U.S. Appl. No. 29/419,922, Nov. 29, 2013, Notice of Allowance.
U.S. Appl. No. 14/357,183, Jul. 16, 2015, Office Action.
U.S. Appl. No. 14/357,183, Nov. 12, 2015, Final Office Action.
U.S. Appl. No. 14/357,183, Jan. 29, 2016, Notice of Allowance.
U.S. Appl. No. 14/370,729, Jan. 26, 2017, Office Action.
U.S. Appl. No. 14/357,190, Feb. 17, 2017, Office Action.
U.S. Appl. No. 14/370,729, Jul. 12, 2017, Final Office Action.
U.S. Appl. No. 14/357,190, Aug. 1, 2017, Final Office Action.
U.S. Appl. No. 14/370,729, Dec. 15, 2017, Office Action.
U.S. Appl. No. 15/901,089, filed Feb. 21, 2018, Pettersson et al.
U.S. Appl. No. 14/357,190, Jan. 12, 2018, Notice of Allowance.
U.S. Appl. No. 14/357,190, Dec. 2017, Notice of Allowance.
U.S. Appl. No. 16/310,406, Dec. 14, 2018, Pettersson et al.
U.S. Appl. No. 62/447,714, Jan. 18, 2017, Osterhout.
U.S. Appl. No. 15/872,770, Jan. 16, 2018, Osterhout.
European Search Report for EP10739040 dated Jan. 31, 2013.
International Search Report and Written Opinion for PCT/US2015/67375 dated Mar. 11, 2016.
International Search Report and Written Opinion for PCT/US18/14275 dated Apr. 4, 2018.
International Search Report and Written Opinion for PCT/US2018/020928 dated Jun. 7, 2018.
International Search Report and Written Opinion PCT/IB2019/052794 dated Jun. 19, 2019.
International Search Report and Written Opinion for PCT/US2019/038142 dated Aug. 2, 2019.
International Search Report and Written Opinion PCT/IB2019/052793 dated Nov. 11, 2019.
International Search Report and Written Opinion for PCT/US2019/049102 dated Dec. 2, 2019.
International Search Report and Written Opinion for PCT/US19/62696 dated Feb. 4, 2020.
U.S. Appl. No. 13/805,602, Mar. 21, 2016, Notice of Allowance.
U.S. Appl. No. 14/370,729, May 21, 2018, Notice of Allowance.
U.S. Appl. No. 15/901,089, Apr. 13, 2020, Office Action.
U.S. Appl. No. 14/970,224, May 30, 2018, Office Action.
U.S. Appl. No. 14/970,224, Aug. 13, 2018, Notice of Allowance.
U.S. Appl. No. 16/109,261, Apr. 28, 2020, Office Action.
U.S. Appl. No. 15/872,770, Mar. 27, 2020, OfifceAction.
European Search Report for application No. EP17175751 dated Aug. 25, 2017.
European Search Report for EP80107577.1 dated Mar. 2, 1981.
European Search Report for EP89115688.7 dated Nov. 2, 1989.
Final Office Action received for U.S. Appl. No. 13/147,787 dated Apr. 17, 2015.
Final Office Action received for U.S. Appl. No. 13/147,787 dated Feb. 16, 2016.
Final Office Action received for U.S. Appl. No. 13/147,787 dated Mar. 7, 2017.
Final Office Action received for U.S. Appl. No. 14/357,183 dated Nov. 12, 2015.
Final Office Action received for U.S. Appl. No. 14/357,190 dated Aug. 1, 2017.
International Search Report and Written Opinion for application No. PCT/US2017/036603 dated Oct. 18, 2017.
International Search Report and Written Opinion received for PCT Patent Application No. PCT/US2019/049535, dated Jun. 9, 2020, 14 pages.
International Search Report and Written Opinion received for PCT Patent Application No. PCT/US2020/012519, dated Jun. 26, 2020, 20 pages.
Office Action received for U.S. Appl. No. 13/147,787 dated Aug. 27, 2014.
Office Action received for U.S. Appl. No. 13/147,787 dated Oct. 28, 2016.
Office Action received for U.S. Appl. No. 13/147,787 dated Sep. 30, 2015.
Office Action received for U.S. Appl. No. 13/805,602 dated Dec. 2, 2015.
Office Action received for U.S. Appl. No. 14/357,183 dated Jul. 16, 2015.
Office Action received for U.S. Appl. No. 14/357,190 dated Feb. 17, 2017.

(56) References Cited

OTHER PUBLICATIONS

Office Action received for U.S. Appl. No. 14/370,729 dated Dec. 19, 2017.
Office Action received for U.S. Appl. No. 29/419,922 dated Aug. 6, 2013.
U.S. Patent Application filed on Jan. 18, 2017, by Osterhout, U.S. Appl. No. 62/447,714.
Final Office Action received for U.S. Appl. No. 15/872,770, dated Sep. 16, 2020, 17 pages.
Non-Final Office Action received for U.S. Appl. No. 16/310,406, dated Aug. 19, 2020, 22 pages.

* cited by examiner

BOX FORMING MACHINE

The present application claims priority to and the benefit of U.S. Provisional Application No. 62/351,127, filed Jun. 16, 2016, and entitled BOX FORMING MACHINE and to U.S. Provisional Application No. 62/425,457, filed Nov. 22, 2016, and entitled BOX FORMING MACHINE, the entireties of which are incorporated herein by reference.

BACKGROUND OF THE INVENTION

1. The Field of the Invention

Exemplary embodiments of the disclosure relate to systems, methods, and devices for converting sheet materials into boxes. More specifically, exemplary embodiments relate to box forming machines that convert paperboard, corrugated board, cardboard, and similar sheet materials into box templates and fold and glue the box templates to form un-erected boxes.

2. The Relevant Technology

Shipping and packaging industries frequently use paperboard and other sheet material processing equipment that converts sheet materials into box templates. One advantage of such equipment is that a shipper may prepare boxes of required sizes as needed in lieu of keeping a stock of standard, pre-made boxes of various sizes. Consequently, the shipper can eliminate the need to forecast its requirements for particular box sizes as well as to store pre-made boxes of standard sizes. Instead, the shipper may store one or more bales of fanfold material, which can be used to generate a variety of box sizes based on the specific box size requirements at the time of each shipment. This allows the shipper to reduce storage space normally required for periodically used shipping supplies as well as reduce the waste and costs associated with the inherently inaccurate process of forecasting box size requirements, as the items shipped and their respective dimensions vary from time to time.

In addition to reducing the inefficiencies associated with storing pre-made boxes of numerous sizes, creating custom sized boxes also reduces packaging and shipping costs. In the fulfillment industry it is estimated that shipped items are typically packaged in boxes that are about 65% larger than the shipped items. Boxes that are too large for a particular item are more expensive than a box that is custom sized for the item due to the cost of the excess material used to make the larger box. When an item is packaged in an oversized box, filling material (e.g., Styrofoam, foam peanuts, paper, air pillows, etc.) is often placed in the box to prevent the item from moving inside the box and to prevent the box from caving in when pressure is applied (e.g., when boxes are taped closed or stacked). These filling materials further increase the cost associated with packing an item in an oversized box.

Customized sized boxes also reduce the shipping costs associated with shipping items compared to shipping the items in oversized boxes. A shipping vehicle filled with boxes that are 65% larger than the packaged items is much less cost efficient to operate than a shipping vehicle filled with boxes that are custom sized to fit the packaged items. In other words, a shipping vehicle filled with custom sized packages can carry a significantly larger number of packages, which can reduce the number of shipping vehicles required to ship the same number of items. Accordingly, in addition or as an alternative to calculating shipping prices based on the weight of a package, shipping prices are often affected by the size of the shipped package. Thus, reducing the size of an item's package can reduce the price of shipping the item. Even when shipping prices are not calculated based on the size of the packages (e.g., only on the weight of the packages), using custom sized packages can reduce the shipping costs because the smaller, custom sized packages will weigh less than oversized packages due to using less packaging and filling material.

Although sheet material processing machines and related equipment can potentially alleviate the inconveniences associated with stocking standard sized shipping supplies and reduce the amount of space required for storing such shipping supplies, previously available machines and associated equipment have various drawbacks. For instance, previously available machines have had a significant footprint and have occupied a lot of floor space. The floor space occupied by these large machines and equipment could be better used, for example, for storage of goods to be shipped. In addition to the large footprint, the size of the previously available machines and related equipment makes manufacturing, transportation, installation, maintenance, repair, and replacement thereof time consuming and expensive.

In addition, previous box forming systems have required the use of multiple machines and significant manual labor. For instance, a typical box forming system includes a converting machine that cuts, scores, and/or creases sheet material to form a box template. Once the template is formed, an operator removes the template from the converting machine and a manufacturer's joint is created in the template. A manufacturer's joint is where two opposing ends of the template are attached to one another. This can be accomplished manually and/or with additional machinery. For instance, an operator can apply glue (e.g., with a glue gun) to one end of the template and can fold the template to join the opposing ends together with the glue therebetween. Alternatively, the operator can at least partially fold the template and insert the template into a gluing machine that applies glue to one end of the template and joins the two opposing ends together. In either case, significant operator involvement is required. Additionally, using a separate gluing machine complicates the system and can significantly increase the size of the overall system.

Accordingly, it would be advantageous to have a relatively small and simple box forming machine that can form box templates and fold and glue the templates in a continuous process without significant manual labor.

BRIEF SUMMARY

Exemplary embodiments of the disclosure relate to systems, methods, and devices for converting sheet materials into boxes. More specifically, exemplary embodiments relate to box forming machines that convert paperboard, corrugated board, cardboard, and similar sheet materials into box templates and fold and glue the box templates to form un-erected boxes.

For instance, one embodiment of a box forming machine includes a converter assembly, a fold assembly, and an attachment assembly. The converter assembly is configured to perform one or more conversion functions on a sheet material to convert the sheet material to a box template. The fold assembly is configured to engage a first end of the box template and move the first end of the box template to a predetermined position. The attachment assembly is configured to engage a second end of the box template and move the second end of the box template toward and into engagement with the first end of the box template.

According to another embodiment, a box forming machine includes a converter assembly mounted on a frame.

The converter assembly is configured to perform one or more conversion functions on a sheet material to convert the sheet material to a box template. A fold assembly is configured to engage a first end of the box template and move the first end of the box template to a predetermined position. The fold assembly comprises a fold head having a fold plate and a first clamp between which the first end of the box template can be selected clamped. The fold head is movably connected to the frame to enable movement of the first end of the box template to the predetermined position. An attachment assembly is configured to engage a second end of the box template and move the second end of the box template toward and into engagement with the first end of the box template. The attachment assembly comprises an attachment head having one or more attachment mechanisms for selectively attaching to the second end of the box template. The attachment head is movably connected to the frame to enable movement of the second end of the box template ward and into engagement with the first end of the box template.

According to another embodiment, a box forming machine includes a converter assembly and an infeed changer. The infeed changer is configured to direct different sheet materials into the converter assembly. The infeed changer includes at least one upper set of guide channels configured to direct a first sheet material into the infeed changer and at least one lower set of guide channels configured to direct a second sheet material into the infeed changer. The infeed changer also includes an active roller that is configured to draw the first or second sheet material into the infeed changer. The active roller is configured to rotate in a first direction and in a second direction. Rotation of the active roller in the first direction draws the first sheet material into the infeed changer and rotation of the active roller in the second direction draws the second sheet material into the infeed changer.

Another embodiment includes a box forming machine having a frame, a converter assembly, and a labeler. The converter assembly is mounted to the frame and is configured to perform one or more conversion functions on a sheet material to convert the sheet material to a box template as the sheet material moves through the convert assembly. The labeler is movably mounted to the frame and is configured to move relative to the box template and apply a label to a desired location on the box template as the box template moves through the converter assembly.

These and other objects and features of the present disclosure will become more fully apparent from the following description and appended claims, or may be learned by the practice of the disclosure as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The embodiments described herein generally relate to systems, methods, and devices for processing sheet materials and converting the same into boxes. More specifically, the described embodiments relate to box forming machines that converts sheet materials (e.g., paperboard, corrugated board, cardboard) into box templates and fold and glue the box templates to form un-erected boxes.

While the present disclosure will be described in detail with reference to specific configurations, the descriptions are illustrative and are not to be construed as limiting the scope of the present invention. Various modifications can be made to the illustrated configurations without departing from the spirit and scope of the invention as defined by the claims. For better understanding, like components have been designated by like reference numbers throughout the various accompanying figures.

As used herein, the term "bale" shall refer to a stock of sheet material that is generally rigid in at least one direction, and may be used to make a box template. For example, the bale may be formed of a continuous sheet of material or a sheet of material of any specific length, such as corrugated cardboard and paperboard sheet materials. Additionally, the bale may have stock material that is substantially flat, folded, or wound onto a bobbin.

As used herein, the term "box template" shall refer to a substantially flat stock of material that can be folded into a box-like shape. A box template may have notches, cutouts, divides, and/or creases that allow the box template to be bent and/or folded into a box. Additionally, a box template may be made of any suitable material, generally known to those skilled in the art. For example, cardboard or corrugated paperboard may be used as the box template material. A suitable material also may have any thickness and weight that would permit it to be bent and/or folded into a box-like shape.

As used herein, the term "crease" shall refer to a line along which the box template may be folded. For example, a crease may be an indentation in the box template material, which may aid in folding portions of the box template separated by the crease, with respect to one another. A suitable indentation may be created by applying sufficient pressure to reduce the thickness of the material in the desired location and/or by removing some of the material along the desired location, such as by scoring.

The terms "notch," "cutout," and "cut" are used interchangeably herein and shall refer to a shape created by removing material from the template or by separating portions of the template, such that a divide through the template material is created.

Figure 1:
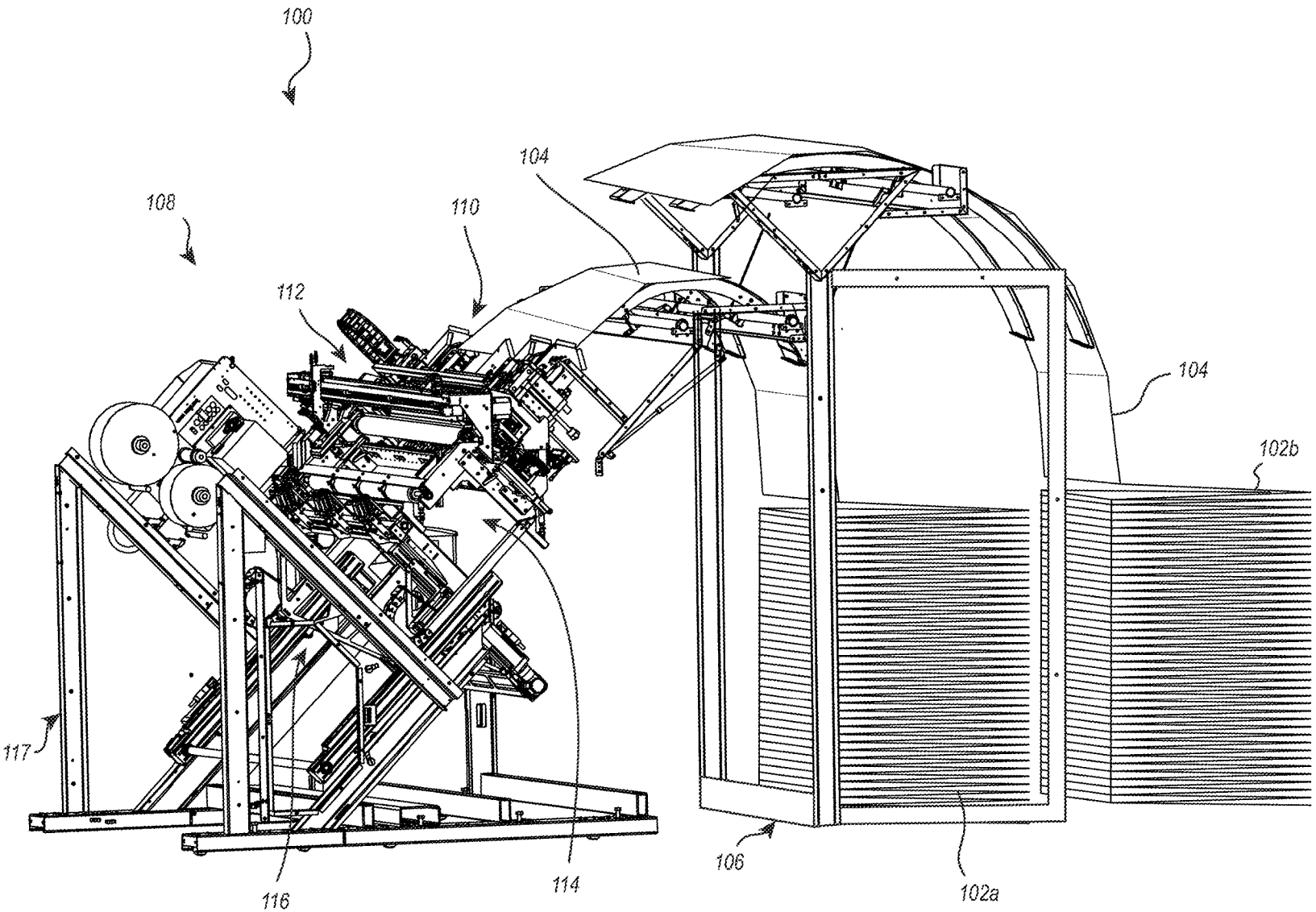
FIG. 1 illustrates a box forming machine as part of a system for forming boxes from sheet material.

FIG. 1 illustrates a perspective view of a system 100 that may be used to create boxes. The system 100 includes bales 102*a*, 102*b* of sheet material 104. The system 100 also includes a feed assembly 106 that helps direct the sheet material 104 into a box forming machine 108. As described in greater detail below, the box forming machine 108 includes a feed changer 110, a converter assembly 112, a fold assembly 114, and an attachment assembly 116. The feed changer 110, converter assembly 112, fold assembly 114, and attachment assembly 116 are mounted on or connected to a frame 117.

Generally, the feed changer 110 is configured to advance the sheet material 104 from a desired bale 102*a*, 102*b* into the converter assembly 112. The bales 102*a*, 102*b* may be formed of sheet material 104 that have different characteristics (e.g., widths, lengths, thickness, stiffness, color, etc.) from one another. As illustrated in FIG. 1, for instance, the width of the bale 102*a* may be smaller than the width of the bale 102*b*. Thus, it may be desirable to use the sheet material 104 from the bale 102*a* to form a smaller box so there is less sheet material wasted.

After the sheet material 104 passes through the feed changer 110, the sheet material 104 passes through the converter assembly 112, where one or more conversion functions are performed on the sheet material 104 to form a box template from the sheet material 104. The conversion functions may include cutting, creasing, bending, folding, perforating, and/or scoring the sheet material 104 in order to form a box template therefrom.

As the box template exits the converter assembly 112, the fold assembly 114 engages the leading end of the sheet material 104/box template. The fold assembly 114 moves and reorients the leading end of the sheet material 104/box template to a known position where glue is applied to the leading end of the sheet material 104/box template. In some embodiments, fold assembly 114 begins moving/reorienting the leading edge of the sheet material 104/box template while the converter assembly 112 continues to perform conversion functions on the sheet material 104 to complete the box template.

While the leading end of the box template is being moved/reoriented and glue is being applied thereto, the remainder of the box template is advanced out of the converter assembly 112. At this point, the attachment assembly 116 engages the trailing end of the box template. The trailing end of the box template and the leading end of the box template are then brought together and joined or attached to one another (to create a manufacturer's joint) with the glue that was previously applied to the leading end of the box template. After the leading and trailing ends of the box template are attached together, the folded and glued box template is an un-erected box. The un-erected box is then released from the box forming machine 108 and can be erected into a box.

Figure 2:
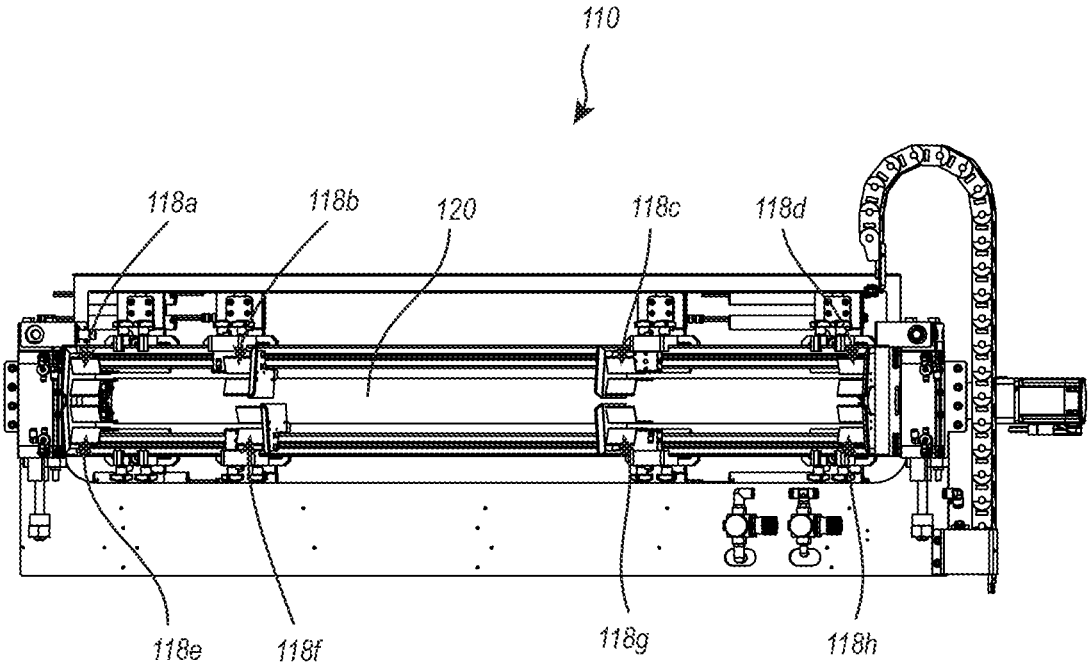
FIG. 2 illustrates a first side view of an infeed changer of the box forming machine of FIG. 1.
Figure 3:
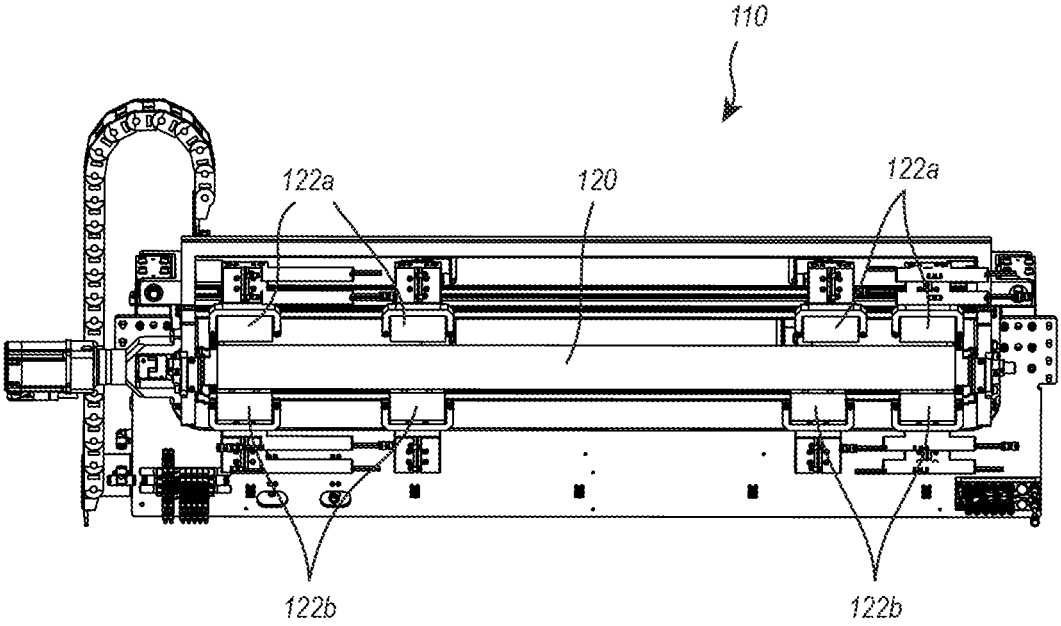
FIG. 3 illustrates a second side view of the infeed changer of the box forming machine of FIG. 1.

Attention is now directed to FIGS. 2 and 3, which illustrate the feed changer 110 in more detail. For the sake of clarity and ease of illustration, FIGS. 2 and 3 show the feed changer 110 without the rest of box forming machine 108. The sheet material 104 enters the feed changer 110 from the first or entry side thereof shown in FIG. 2. The sheet material 104 exits the feed changer 110 from the second or exit side thereof illustrated in FIG. 3.

As can be seen in FIG. 2, the feed changer 110 may include one or more guide channels 118 (118*a*-118*h*). The guide channels 118 may be configured to flatten the sheet material 104 so as to feed a substantially flat sheet thereof through converter assembly 112. As shown, for instance, each guide channel 118 includes opposing upper and lower guide plates that are spaced apart sufficiently to allow the sheet material 104 to pass therebetween, but also sufficiently close enough together to flatten the sheet material 104. In some embodiments, as shown in FIG. 2, the upper and lower guide plates may be flared or spaced further apart at on opening end to facilitate insertion of the sheet material 104 therebetween.

Some of the guide channels 118 may be held or secured in a fixed position along the width of the feed changer 110 while other guide channels 118 are able to move along at least a portion of the width of the feed changer 110. In the illustrated embodiment, the feed changer 110 includes movable guide channels 118*b*, 118*c*, 118*f*, 118*g*, and fixed guide channels 118*a*, 118*d*, 118*e*, 118*h*. More specifically, fixed guide channels 118*a*, 118*d*, 118*e*, 118*h* may be secured in place near opposing sides of the feed changer 110. Movable guide channels 118*b*, 118*c*, 118*f*, 118*g* are disposed between left and right sides of the feed changer 110 and fixed guide channels 118*a*, 118*d*, 118*e*, 118*h* such that the movable guide channels 118*b*, 118*c*, 118*f*, 118*g* are able to move back and forth between the opposing sides of feed changer 110 and the fixed guide channels 118*a*, 118*d*, 118*e*, 118*h*.

The movable guide channels 118*b*, 118*c*, 118*f*, 118*g* may be able to move so feed changer 110 can accommodate sheet materials 104 of different widths. For instance, movable guide channels 118*b* may be able to move closer to fixed guide channel 118*a* when a narrower sheet material 104 is being converted than when a wider sheet material 104 is being converted. When a wider sheet material 104 is being converted, movable guide channels 118*b* may be moved away from fixed guide channels 118*a* so that the wider sheet material 104 may be passed between guide channels 118*a*, 118*b*. Similarly, movable guide channel 118*c* may be movable relative to fixed guide channel 118*d* to accommodate different widths of sheet materials 104. Likewise, movable guide channels 118*f*, 118*g* may be movable relative to fixed guide channels 118*e*, 118*h*, respectively, to accommodate different widths of sheet materials 104.

The movable guide channels 118*b*, 118*c*, 118*f*, 118*g* may be biased toward their respective fixed guide channels 118*a*, 118*d*, 118*e*, 118*h* so that, regardless of how wide the sheet material 104 is, the sets of movable and fixed guide channels 118 will be properly spaced apart to guide the sheet material 104 straight through the feed changer 110. The movable guide channels 118*b*, 118*c*, 118*f*, 118*g* may be biased toward the fixed guide channels 118*a*, 118*d*, 118*e*, 118*h* with springs or other resilient mechanisms.

In the illustrated embodiment, the feed changer 110 includes four sets of guide channels 118 (e.g., fixed guide channel 118*a* and movable guide channel 118*b*; movable guide channel 118*c* and fixed guide channel 118*d*; fixed guide channel 118*e* and movable guide channel 118*f*; movable guide channel 118*g* and fixed guide channel 118*h*) that guide lengths of the sheet material 104 into the feed changer 110. In the illustrated embodiment, the sets of guide channels 118 are arranged in a two-by-two column and row pattern. One row includes the guide channel set 118*a*, 118*b* and the guide channel set 118*c*, 118*d*, while the second row includes the guide channel set 118*e*, 118*f* and the guide channel set 118*g*, 118*h*. Similarly, one column includes guide channel set 118*a*, 118*b* and the guide channel set 118*e*, 118*f*, while the second column includes the guide channel set 118*c*, 118*d* and the guide channel set 118*g*, 118*h*.

The guide channel sets that are in the same row are horizontally offset from one another and vertically aligned with one another. In contrast, the guide channel sets that are in the same column are vertically offset from one another and can be at least partially aligned with one another. For instance, the fixed guide channels 118*a*, 118*e* are horizontally aligned and vertically offset from one another. Due to their ability to move to accommodate sheet materials 104 of different widths, the movable guide channels 118*b*, 118*f* may or may not be vertically aligned with one another. Similarly, the movable guide channels 118*fc* 118*g* may or may not be vertically aligned with one another.

While the feed changer 110 is shown and described with four sets of guide channels in a two-by-two arrangement, it will be understood that the feed changer 110 may include one or multiple sets of guide channels in one or more rows and one or more columns for feeding one or multiple, side-by-side and/or vertically offset lengths of sheet material 104 (e.g., from multiple bales 102) through the feed changer 110.

As illustrated in FIGS. 2 and 3, the feed changer 110 also includes multiple feed rollers that pull the sheet material 104 into the feed changer 110 and advance the sheet material 104 through the feed changer 110 and into the converter assembly 112. More specifically, the illustrated embodiment includes an active feed roller 120 and multiple pressure feed rollers 122 (e.g., top pressure feed rollers 122*a*, bottom pressure feed rollers 122*b*). The active feed roller 120 may be actively rolled by an actuator or motor in order to advance the sheet material 104. Although the pressure feed rollers 122 are not typically actively rolled by an actuator, pressure feed rollers 122 may nevertheless roll to assist with the advancement of the sheet material 104.

The active feed roller 120 is secured to the feed changer 110 such that the active feed roller 120 is maintained in generally the same position. In contrast, at least some of the pressure feed rollers 122 may be movable along at least a portion of the width of the feed changer 110. For instance, depending on the size of the box template being formed, the pressure feed rollers 122 may be moved closer together or further apart to help advance the sheet material 104 is a generally straight direction.

In some embodiments, such as the illustrated embodiment, each of the pressure feed rollers 122 is connected to or otherwise associated with a guide channel 118. Thus, the pressure feed rollers 122 associated with the movable guide channels 118*b*, 118*c*, 118*f*, 118*g* move with movement of the movable guide channels 118*b*, 118*c*, 118*f*, 118*g*. For instance, if movable guide channel 118*b* is moved to accommodate a wider or narrower length of sheet material 104, then the pressure feed roller 122*a* associated with guide channel 118*b* will move so as to be aligned with the wider or narrower length of sheet material 104.

In the illustrated embodiment, there are top pressure feed rollers 122*a* and bottom pressure feed rollers 122*b*. The top pressure feed rollers 122*a* are disposed generally vertically above the active feed roller 120 and the bottom pressure feed rollers 122*b* are disposed generally vertically below the active feed roller 120. The positioning of the top and bottom pressure feed rollers 122*a*, 122*b* and the rotational direction of the active feed roller 120 allows for sheet material 104 from different bales 102 to be advanced into and through the feed changer 110.

For instance, if the active feed roller 120 is rotated in a first direction (i.e., with the top surface of the active feed roller 120 rotating in a direction generally from the entry side of the feed changer 110 shown in FIG. 2 toward the exit side of the feed changer 110 shown in FIG. 3), sheet material 104 disposed between one or both of the top sets of guide channels (i.e., fixed guide channel 118*a* and movable guide channel 118*b*; movable guide channel 118*c* and fixed guide channel 118*d*) will be advanced through the feed changer 110. In contrast, if the active feed roller 120 is rotated in a second direction (i.e., with the bottom surface of the active feed roller 120 rotating in a direction generally from the entry side of the feed changer 110 shown in FIG. 2 toward the exit side of the feed changer 110 shown in FIG. 3), sheet material 104 disposed between one or both of the bottom sets of guide channels (fixed guide channel 118*e* and movable guide channel 118*f*; movable guide channel 118*g* and fixed guide channel 118*h*) will be advanced through the feed changer 110. Thus, by simply changing the rotational direction of the active feed roller 120, sheet material 104 from different bales 102 can be selected and advanced through the feed changer 110.

In some embodiments, the pressure feed rollers 122 may be moved between active and inactive positions. In the inactive position, the pressure feed rollers 122 may not press the sheet material 104 against the active feed roller 120 (or at least not with enough pressure) to allow the active feed roller 120 to advance the sheet material 104. In contrast, when the pressure feed rollers 122 are moved to the active position, the pressure feed rollers 122 may press the sheet material 104 against the active feed roller 120 with enough pressure so that the active feed roller 120 advances the sheet material 104.

Figure 4:
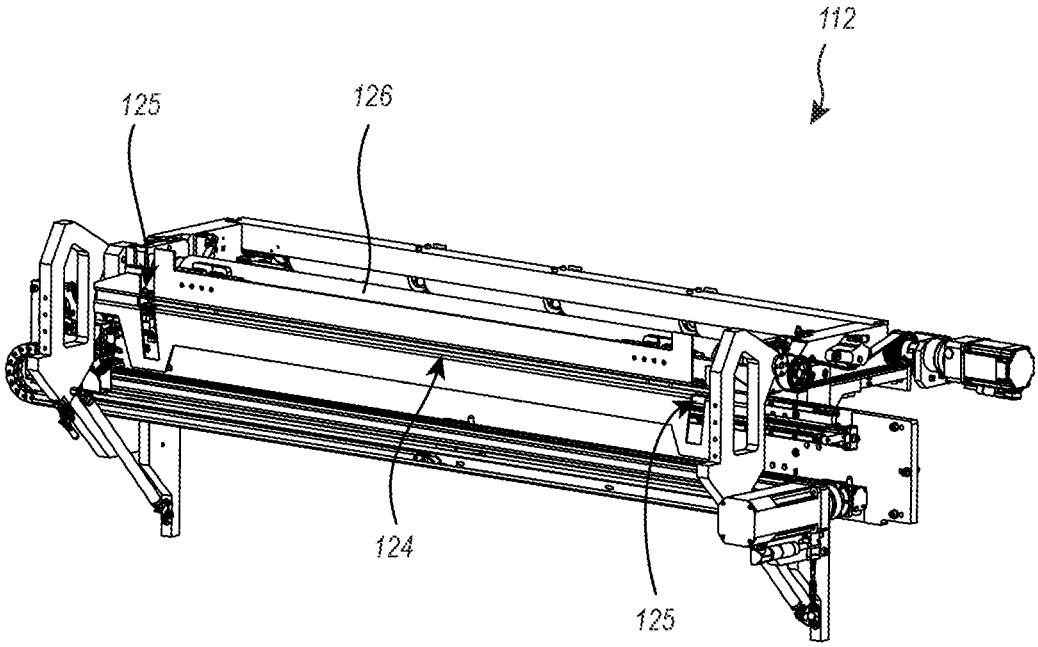
FIG. 4 illustrates a first side view of a converter assembly of the box forming machine of FIG. 1.
Figure 5:
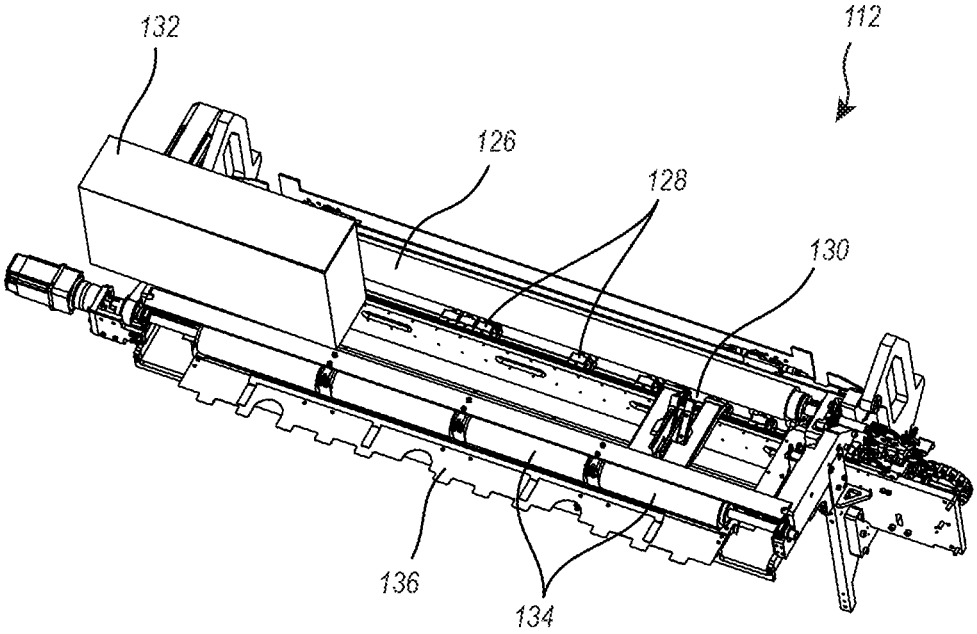
FIG. 5 illustrates a second side view of the converter assembly of the box forming machine of FIG. 1.

Attention is now directed to FIGS. 4 and 5, which illustrate the converter assembly 112 in more detail. For the sake of clarity and ease of illustration, FIGS. 4 and 5 show the converter assembly 112 without the rest of the box forming machine 108. The sheet material 104 enters the converter assembly 112 from the first or entry side thereof shown in FIG. 4. The sheet material 104 exits the converter assembly 112 from the second or exit side thereof illustrated in FIG. 5.

In the illustrated embodiment, the converter assembly 112 includes an infeed slot 124 in the first side thereof. The infeed slot 124 receives the sheet material 104 as it exits the feed changer 110 and directs the sheet material 104 into the converter assembly 112. In the illustrated embodiment, the infeed slot 124 has a flared open end to assist with guiding the sheet material 104 into the converter assembly. The infeed slot 124 also includes one or more notches 125. The one or more notches 125 may at least partially receive therein ends of the fixed guide channels 118*a*, 118*d*, 118*e*, 118*h* (opposite the flared open ends thereof). Thus, ends of the fixed guide channels 118*a*, 118*d*, 118*e*, 118*h* may extend at least partially into the infeed slot 124. Extending the fixed guide channels 118*a*, 118*d*, 118*e*, 118*h* into the infeed slot 124 can assist with a smooth transition of the sheet material 104 from the feed changer 110 to the converter assembly 112. For instance, the fixed guide channels 118*a*, 118*d*, 118*e*, 118*h* can maintain the sheet material 104 is a flat configuration as the sheet material enters the infeed slot 124, thereby reducing or eliminating the possibility of the sheet material 104 getting caught in the transition from the feed changer 110 to the converter assembly 112.

After passing through the infeed slot 124, the sheet material 104 is engaged by an active feed roller 126. The active feed roller 126 rotates to advance the sheet material 104 through the converter assembly 112. As the sheet material 104 advances through the converter assembly 112, one or more converting tools 128 perform conversion functions (e.g., crease, bend, fold, perforate, cut, score) on the sheet material 104 in order to create packaging templates out of the sheet material 104. Some of the conversion functions may be made on the sheet material 104 in a direction substantially perpendicular to the direction of movement and/or the length of the sheet material 104. In other words, some conversion functions may be made across (e.g., between the sides) the sheet material 104. Such conversions may be considered "transverse conversions." In contrast, some of the conversion functions may be made on the sheet material 104 in a direction substantially parallel to the direction of movement and/or the length of the sheet material 104. Such conversions may be considered "longitudinal conversions." Additional details, including structures and functions, regarding converting tools that may be used in the converter assembly 112 are disclosed in United States Patent Publication No. 2015/0018189, published on Jan. 15, 2015, and entitled CONVERTING MACHINE (the "'189 Application"), the entire content of which is incorporated herein by reference.

Some of the conversion functions may include cutting excess material off of the sheet material 104. For instance, if the sheet material 104 is wider than needed to form a desired box template, part of the width of the sheet material 104 can be cut off by a conversion tool. The excess material or trim can be diverted out of the converter assembly 112 by one or more diverter tools 130. As illustrated in FIG. 5, the diverter tool 130 includes an angled surface that redirects the trim through a bottom or lower opening in the converter assembly 112. As a result, the trim does not exit the second or exit side of the converter assembly 112 like the box template does. Rather, the trim is directed out of the converter assembly 112 prior to the exit side thereof so that the trim is separated from the completed box template.

As discussed in the '189 application, the converting tools can be repositioned along the width of the sheet material 104 in order to perform the conversion functions at desired locations along the width of the sheet material 104. Thus, for instance, the converting tools 128 shown FIG. 5 can be repositioned along the width of the converter assembly 112 in order to cut the sheet material 104 at a desired locations to remove a desired about of trim therefrom.

The diverter tool 130 may be connected to or otherwise associated with one of the converting tools 128 (e.g., a cutting wheel or knife) that cuts the trim from the sheet material 104. As a result, when the converting tool 128 is moved to the required position to cut the desired amount of trim from the sheet material 104, the diverter tool 130 moves with the converting tool 128 so that the diverter tool 130 is properly positioned to redirect the trim out of the converter assembly 112.

A label or other identifier can be applied to the sheet material 104 (at least partially formed box template) during advancement through the converter assembly 112. For instance, as shown in FIG. 5, the converter assembly 112 may include a labeler 132 movably mounted thereto. The labeler 132 may move between opposing sides of the converter assembly 112 and may apply labels to the at least partially formed box templates. Because there can be multiple side-by-side tracks of sheet material 104 processed through the converter assembly 112 and because the box templates vary in sizes, the label 132 needs to be able to apply labels at various positions along the width of the converter assembly.

A control system can control the operation of the box forming machine 108. More specifically, the control system can control the movement and/or placement of the various components of the box forming machine 108. For instance, the control system can control the rotational direction of the active feed roller 120 in order to select the desired sheet material 104 and the positioning of the converting tools 128 to perform the conversion functions on the desired locations of the sheet material 104.

Similarly, the control system can control the operation of the labeler 132. By way of example, the control system can cause the labeler 132 to print and apply a label to a particular box template. For instance, during the formation of a box template that will be used to ship a particular order to a particular shipping address, the control system can cause the labeler 132 to print desired information (e.g., shipping address, packing list, etc.) on a label. As the box template moves through the converter assembly 112, the control system can cause the labeler 132 to move over the box template and apply the label to the box template.

In some embodiments, the labeler 132 applies the label to the box template as the box template is moving through the converter assembly 112, which can reduce the time required to form and label the box template. In other embodiments, however, the movement of the box template through the converter assembly 112 can be paused long enough for the labeler 132 to apply the label.

The control system can also monitor the position and operation of the various components of the box forming machine 108 to enable the labeler 132 to apply the labels to desired locations on the box templates. For instance, the control system can monitor the rotational speed of the active rollers 120, 126. The rotational speed of the rollers 120, 126 can be used to determine the speed at which the sheet material 104 is moving through the box forming machine 108. Similarly, the control system can monitor the location of the converting tools and/or when the converting tools are activated to perform the conversion functions on the sheet material 104.

For a standard box template, the converting tools create cuts and creases in the sheet material 104 to define different sections of the box template. The different sections of the box template may include wall sections and closure flap sections. By monitoring the operation and/or positions of the components of the box forming machine 108, the control system can move the labeler 132 and cause the labeler 132 to apply the label at a particular time so that the label is applied at a particular place or within a particular area on the box template. In some embodiments, for instance, it may be desired to have the label applied to a particular wall section or closure flap. By monitoring the position and/or operation of the components of the box forming machine 108, the control system is able to direct the labeler 132 to the proper position over the box template (e.g., over the desired wall section or closure flap) and cause the labeler to apply the label at the proper time (when the desired wall section or closure flap moves or is positioned underneath the labeler 132).

One or more additional feed rollers 134 are positioned near the exit or second side of the converter assembly 112. The feed roller(s) 134 may be active rollers (similar to rollers 120, 126) or passive rollers (similar to rollers 122). The feed roller(s) 134 may assist in directing the box template out of the converter assembly 112. More specifically, the feed roller(s) 134 may press the box template against the outfeed plate 136 so the box template exits the converter assembly 112 at a known orientation and/or position.

Figure 6:
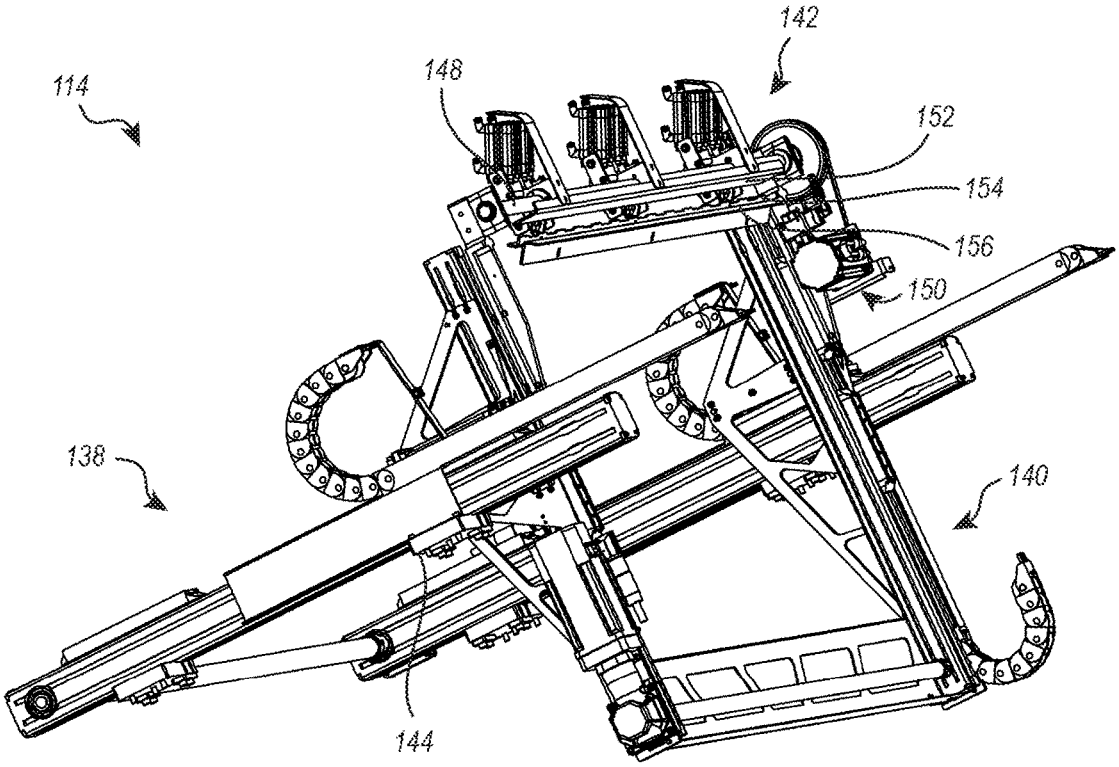
FIG. 6 illustrates a perspective view of a fold assembly of the box forming machine of FIG. 1.
Figure 7A:
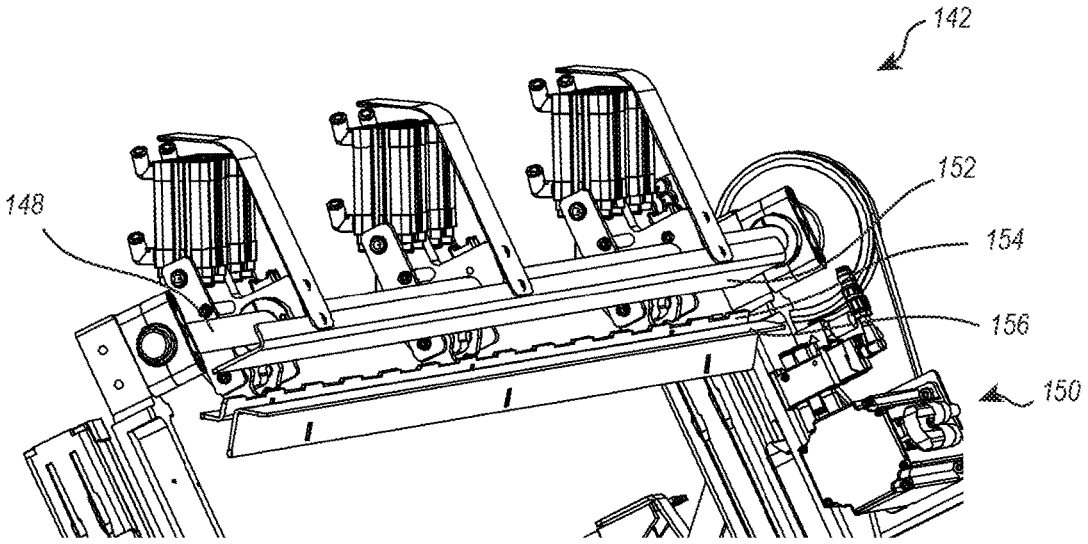
FIG. 7A illustrates a perspective view of a fold head of the fold assembly of FIG. 6.
Figure 7B:
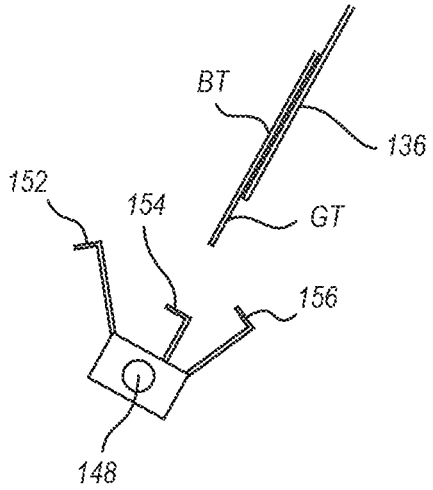
FIGS. 7B-7E illustrate the fold head of FIG. 7A interacting with a box template.
Figure 7C:
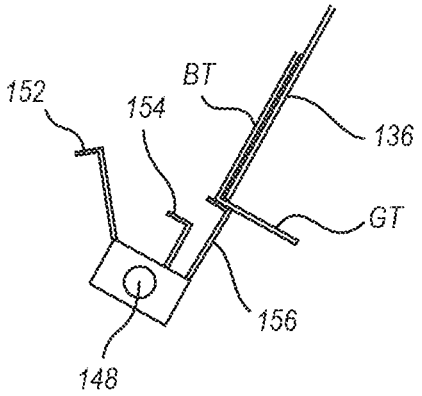
Figure 7D:
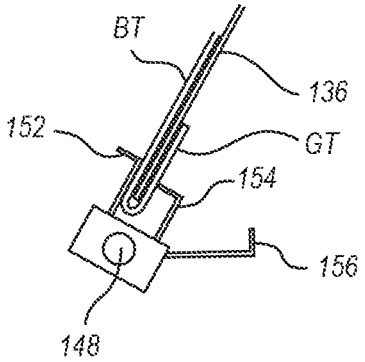
Figure 7E:
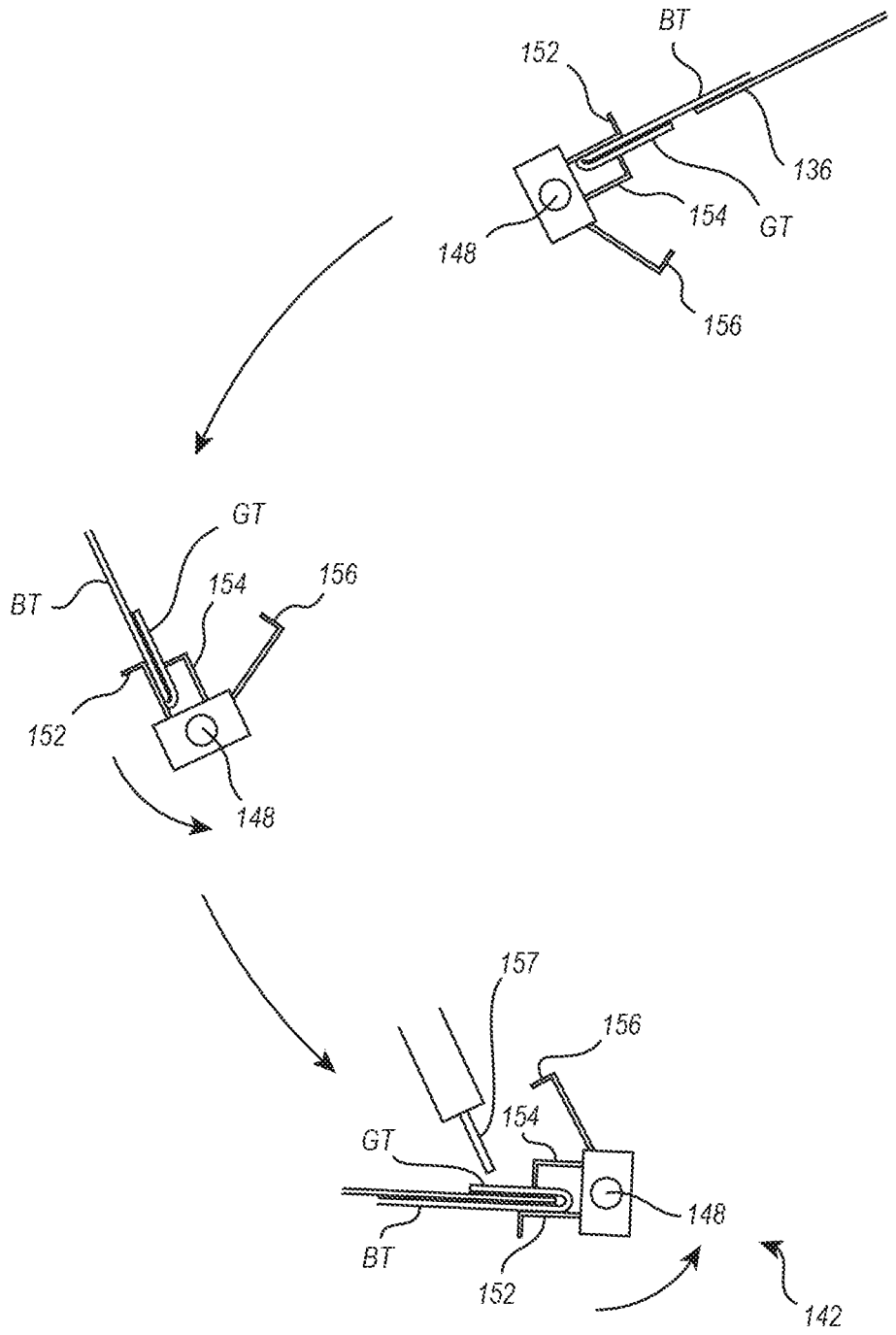

Attention is now directed to FIGS. 6-7E, which illustrate the fold assembly 114 in more detail. For the sake of clarity and ease of illustration, FIGS. 6-7E show the fold assembly 114 without the rest of box forming machine 108. Furthermore, FIGS. 7B-7E show a simplified version of a portion of the fold assembly 114 and the interactions with a box template. The fold assembly 114 engages the box templates formed with sheet material 104 as the box templates exit the converter assembly 112. As discussed in greater detail below, the fold assembly 114 is configured to engage and move and/or reorient a first end of a box template so glue can be applied thereto and so that a second end of the box template can be attached to the first end.

As can be seen in FIG. 6, the fold assembly 114 includes first and second sub-frames 138, 140 and a fold head 142. The first sub-frame 138 is slidably and/or pivotally mounted to the frame 117 (FIG. 1). For instance, the first sub-frame 138 may include one or more tracks, recesses, grooves, or the like that interact with the one or more track clamps connected to the frame 117 to allow the first sub-frame 138 to slide through and/or pivot relative to the one or more track clamps. The track clamps may be fixedly secured to the frame 117. Similarly, the second sub-frame 140 may be slidably and/or pivotally mounted to the first sub-frame 138 via one or more track clamps 144. For instance, the second sub-frame 140 may include one or more tracks, recesses, grooves, or the like that interact with the one or more track clamps 144 connected to the first sub-frame 138 to allow the second sub-frame 140 to slide through and/or pivot relative to the one or more track clamps 144 on the first sub-frame 138.

The movable nature of the first and second sub-frames 138, 140 enables the fold head 142 to move in a variable range of motion in an X-Y field. As a result, the fold head 142 can be moved vertically up and down relative to the converter assembly 112 and/or horizontally closer to and further from the converter assembly 112.

In addition to the movement available to the fold head 142 from the movement of the first and second sub-frames 138, 140, the fold head 142 is movably mounted on the second sub-frame 140. More specifically, as shown in FIGS. 6 and 7A, the fold head 142 includes a shaft 148 that is rotatably mounted to the second sub-frame 140 and which can be rotated by an actuator 150. The actuator may take various forms. For instance, in the illustrated embodiment, the actuator 150 includes a motor and a drive belt. Mounted on the shaft 148 is a fold plate 152 and first and second clamps 154, 156. The first and second clamps 154, 156 can each be moved via one or more actuators.

In operation, the fold head 142 can be moved adjacent to the outfeed plate 136 of the converter assembly 112 so as to be able to engage the box template as the box template exits the converter assembly 112. For instance, FIG. 7B illustrates the fold head 142 positioned adjacent to the outfeed plate 136 of the converter assembly 112. FIG. 7B also shows a first end of a box template BT exiting the converter assembly 112. As shown, the box template BT can be advanced out of the converter assembly 112 so that a glue tab GT extends beyond the edge of the outfeed plate 136 and so that a crease between the glue tab GT and an adjacent panel on the box template BT is aligned with the edge of the outfeed plate 136.

Once the glue tab GT is so positioned (i.e., with the crease aligned with the edge of the outfeed plate 136), the fold head 142 can rotate into engagement with the glue tab GT to fold the glue tab GT relative to the rest of the box template BT. FIG. 7C shows the fold head 142 rotating about the shaft 148 and or moving relative to the box template BT to fold the glue tab GT. As noted above, the glue tab GT is positioned with a crease aligned with the edge of the outfeed plate 136. The alignment of the crease and the rotation/movement of the fold head 142 causes the glue tab GT to predictably fold along the crease. The fold head 142 can continue to rotate and/or move (e.g., toward the converter assembly 112) until the glue tab GT is folded against the back surface of the outfeed plate 136 as shown in FIG. 7D.

Once the glue tab is folded, the fold plate 152 and/or the first clamp 154 can be moved from a first or open position (FIG. 7A) to a second or closed position as shown in FIG. 7D. When the fold plate 152 and the first clamp 154 are in the closed position, the folded edge of the box template BT is clamped or held between the fold plate 152 and the first clamp 154 as shown in FIG. 7D. In some embodiments, the first clamp 154 clamps onto about 25 mm or less of the folded edge of the box template BT. In other embodiments, the first clamp 154 clamps onto about 20 mm, 15 mm, 10 mm or less of the folded edge of the box template BT.

With the folded edge of the box template BT clamped or held between the fold plate 152 and the first clamp 154, the fold head 142 can then move and/or reorient the first end of the box template BT. For instance, as shown in FIG. 7E, the fold head 142 can move away from the outfeed plate 136, thereby pulling the folded box template BT off of the outfeed plate 136.

In some embodiments, the edges of the outfeed plate 136 (FIG. 5) and the first clamp 154 (FIGS. 6 and 7A) include notched configurations. More specifically, the edge of the outfeed plate 136 includes a plurality of spaced apart notches. Similarly, the edge of the first clamp 154 that engages the box template includes a plurality of spaced apart notches. In some embodiments, the notches on the first clamp 154 are offset from the notches on the outfeed plate 136. Offset notches can reduce the amount of friction between the box template BT and the outfeed plate 136 when the folded box template BT is pulled off of the outfeed plate 136.

Once the first end of the box template BT has been pulled off of the outfeed plate 136, the fold head 142 can move and/or reorient (via the movement of the first and second sub-frames 138, 140 and/or rotation of the fold head 142) the first end of the box template BT to a desired position and/or orientation. For instance, as illustrated in FIG. 7E, the fold head 142 can move horizontally and vertically away from the outfeed plate 136. Due to the folded end of the box template BT being clamped between the fold plate 152 and the first clamp 154, the folded end of the box template BT can also move horizontally and vertically away from the outfeed plate 136. As noted above, the horizontal and vertical movement of the fold head 142 can be accomplished with the movement of the first and second sub-frames 138, 140.

As noted above, the fold head 142 can also rotate about the shaft 148 in order to reorient the folded end of the box template BT. In the embodiment illustrated in FIG. 7E, for instance, the fold head 142 is illustrated as being rotated clockwise about the shaft 148. As the fold head 142 rotates, the folded end of the box template BT is reoriented. More specifically, when the fold head 142 initial clamps onto the folded edge of the box template BT, the exposed surface of the glue tab GT is facing generally downward. As the fold head 142 rotates, the exposed surface of the glue tab GT is reoriented until it is facing generally upward, as shown in the lower portion of FIG. 7E.

Thus, the fold assembly 114 can fold the glue tab GT relative to the rest of the box template BT and clamp onto the folded edge of the box template BT. Thereafter, the fold assembly 114 can move and/or reorient the folded edge (at the first end) of the box template BT from a first location and/or orientation (adjacent to the outfeed plate 136, with the glue tab GT facing generally downward) to a second location and/or orientation (vertically lower than the outfeed plate 136, with the glue tab GT facing generally upward) so that the glue tab GT is positioned and oriented in a predetermined or known position and/or orientation.

As shown in FIG. 7E, the second location and/or orientation may be situated to enable a gluing device 157 to apply glue to the exposed surface of the glue tab GT. For instance, once the folded edge of the box template BT is in the second location and/or orientation, the gluing device 157 may move relative to the glue tab GT in order to apply glue thereto. The gluing device 157 may be connected to the frame 117 such that the gluing device 157 (or a portion thereof) can move between opposing sides of the box forming machine 108 to apply glue to the glue tab GT of the box template BT.

While the folding head 142 is moving and/or repositioning the folded edge of the box template BT and glue is being applied thereto, the box template BT may continue to be fed out of the converter assembly 112. As will be discussed in greater detail below, the movement/reorientation of the folded edge of the box template BT and the additional feeding out of the box template BT from the converter assembly 112 can cause the box template BT to fold in half.

Once the second end of the box template BT reaches the exit side of the converter assembly 112, the attachment assembly 116 engages the second end of the box template BT. With the second end of the box template BT engaged, the attachment assembly 116 moves and/or reorients the second end of the box template BT to bring the second end into engagement with the first end thereof in order to attach together the first and second ends of the box template BT.

Figure 8:
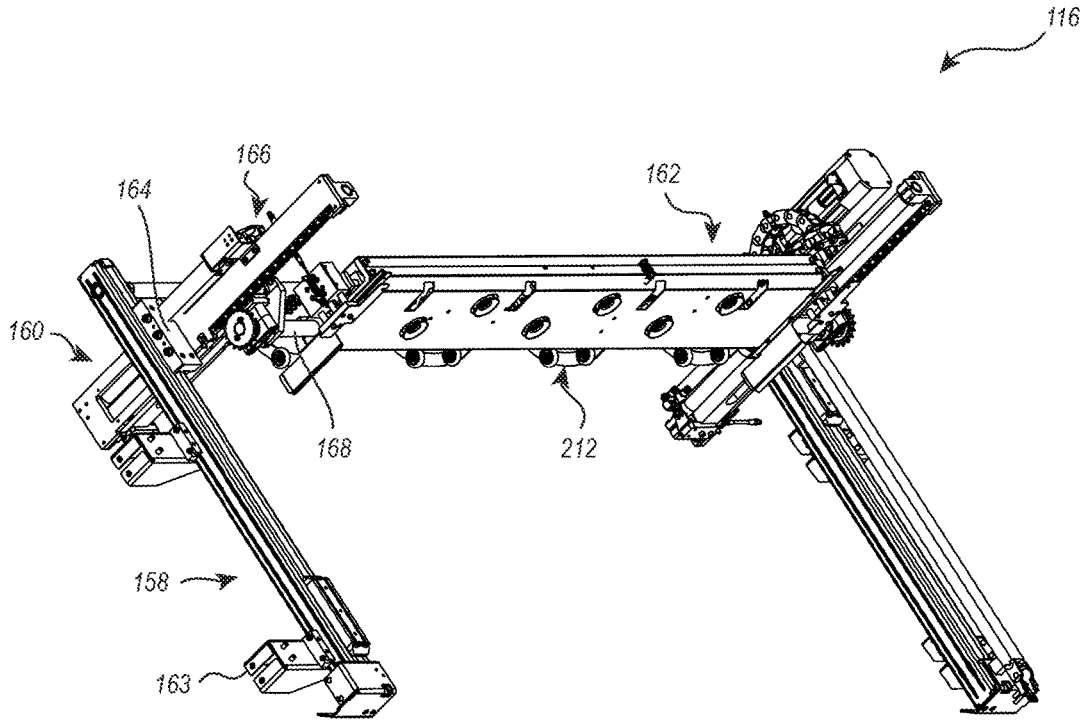
FIG. 8 illustrates a perspective view of an attachment assembly of the box forming machine of FIG. 1.

As illustrated in FIG. 8, the attachment assembly includes first and second sub-frames 158, 160 and an attachment head 162. In the illustrated embodiment, the first sub-frame 158 may be slidably and/or pivotally mounted to the frame 117 (FIG. 1) via one or more track clamps 163. As with the first sub-frame 138, the first sub-frame 158 may include one or more tracks, recesses, grooves, or the like that interact with one or more track clamps 163 to allow the first sub-frame 158 to slide through and/or pivot relative to the one or more track clamps 163 and allow the first sub-frame 158 to slide and/or pivot relative to the frame 117.

The second sub-frame 160 is slidably mounted to the first sub-frame 158 via one or more track clamps 164. The second sub-frame 160 can slide along and/or pivot relative to the first sub-frame 158 via the track clamps 164. Additionally, the second sub-frame 160 is selectively extendable via one or more extension mechanisms 166. The extension mechanism(s) 166 can be selectively extended or retracted in order to move the attachment head 162.

The movable nature of the first and second sub-frames 158, 160 (including the extension/retraction of the extension mechanism(s) 166) enables the attachment head 162 to move in a range of motion in an X-Y field. As a result, the attachment head 162 can move vertically up and down relative to the converter assembly 112 and/or horizontally closer to and further from the converter assembly 112.

In addition to the movement available to the attachment head 162 from the movement of the first and second sub-frames 158, 160, the attachment head 162 is movably mounted on the second sub-frame 160. More specifically, the attachment head 162 includes a shaft 168 that is rotatably mounted to the second sub-frame 160 and which can be rotated by an actuator.

Figure 9:
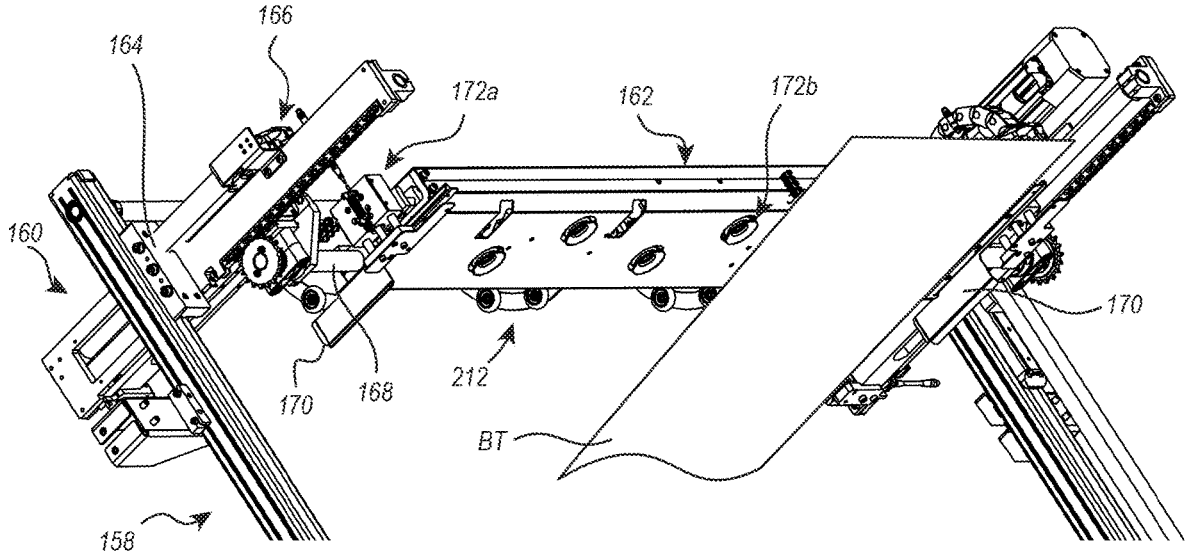
FIG. 9 illustrates a perspective view of an attachment head of the attachment assembly of FIG. 8.
Figure 10:
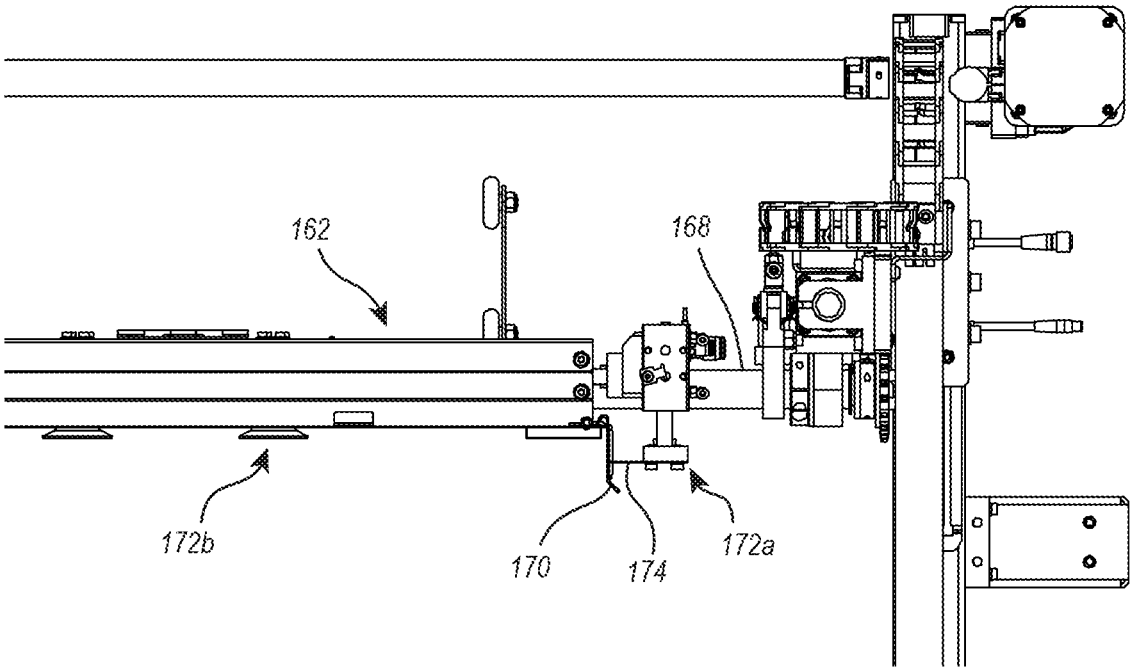
FIGS. 10 and 11 illustrate partial views of the attachment head of the attachment assembly of FIG. 8.
Figure 11:
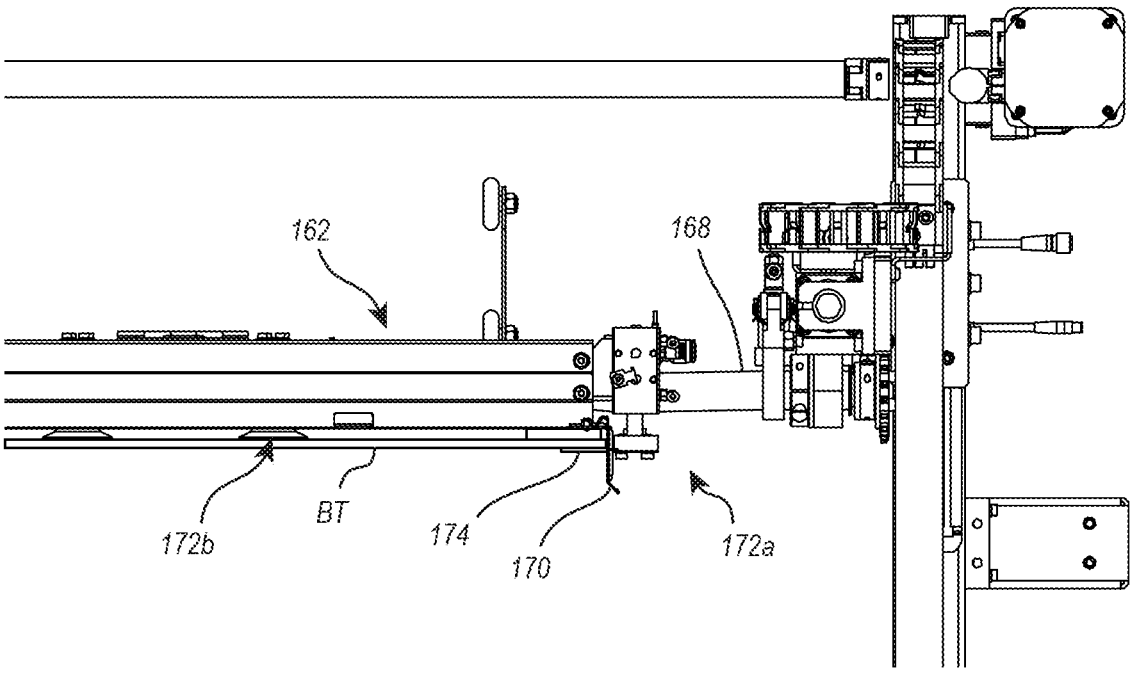

As can be seen in FIGS. 9-11, the attachment head 162 can include one or more guides 170. The one or more guides 170 can be disposed on one or both sides of the attachment head 162. The one or more guides 170 can help with alignment of the box template BT relative to the attachment head 162.

The attachment head 162 can also include one or more attachment mechanisms 172. For instance, as illustrated in FIGS. 9-11, the attachment head 162 can include an attachment mechanism 172*a* and/or an attachment mechanism 172*b*. In the illustrated embodiment, the attachment mechanism 172*a* is slidably mounted on the shaft 168 such that the attachment mechanism 172*a* can move closer to or further away from a box template BT. For instance, FIG. 10 illustrates the attachment mechanism 172*a* position that on the shaft 168 in a retracted position. In the retracted position, a clamp 174 of the attachment mechanism 172*a* is positioned outside of the guide 170 such that the attachment mechanism 172*a* is not aligned with the box template BT. In contrast, FIG. 11 illustrates the attachment mechanism 172*a* position on the shaft 168 in an engaged position. In the engaged position, the clamp 174 of the attached mechanism 172*a* extends beyond (inside) the guide 170 toward the middle of the attachment head 162 such that the clamp 174 is aligned width or least partially overlaps the box template BT.

In addition to the attachment mechanism 172*a* being movable on the shaft 168 between a retracted and engaged positions, the clamp 174 can be selectively extended or retracted in order to engage or release a portion of the box template BT. In FIG. 10, for example, the clamp 174 is extended away from the shaft 168. As result, when the attachment mechanism 172*a* is moved from the retracted position shown in FIG. 10 to be engaged position shown in FIG. 11, the clamp 174 can be positioned below the box template BT so that the box template BT is positioned between the clamp 174 and another portion of the attachment head 162. Once the box template BT is positioned between the clamp 174 and another portion of the attachment head 162, the clamp 174 can be moved to the engaged position so as to clamp the box template BT between the clamp 174 and another portion of the attachment head 162, as shown in FIG. 11.

In some embodiments the surface of the clamp 174 that engages the box template BT may be configured for engaging the box template BT in a secure and/or nonslip manner. For instance, the clamp 174 may include a rubber or other nonslip surface. The clamp 174 may also or alternatively include one or more projections (such as a set screw or spikes) that engage the box template BT to ensure a secure connection therewith.

In some embodiments, in addition or as an alternative to the attachment mechanism 172*a*, the box template BT can be engaged and selectively attached to the attachment head 162 with the attachment mechanism 172*b*. In the illustrated embodiment, the attachment mechanism 172*b* includes one or more vacuum heads. As shown in FIG. 11, the one or more vacuum heads can engage a planar surface of the box template BT and use a negative pressure to selectively secure the box template BT to the attachment head 162.

As can be best seen in FIG. 9, the attachment mechanism 172*b* can include an array of vacuum heads that are aligned in one or more rows. The illustrated embodiment includes two rows of vacuum heads, but the attachment mechanism 172*b* may include a single row or more than two rows of vacuum heads. Additionally the illustrated embodiment shows that the rows of vacuum heads are offset from one another. Offsetting the rows of vacuum heads can help ensure that a vacuum head is able to make secure contact with the box template BT. For instance, the box template BT may include various creases, scores, or other surface irregularities that make it difficult for one vacuum head to securely attach to the box template BT. In such instances, an offset vacuum head may be able to securely engage another portion of the box template BT that is free from such creases, scores, or other surface irregularities.

Figure 12A:
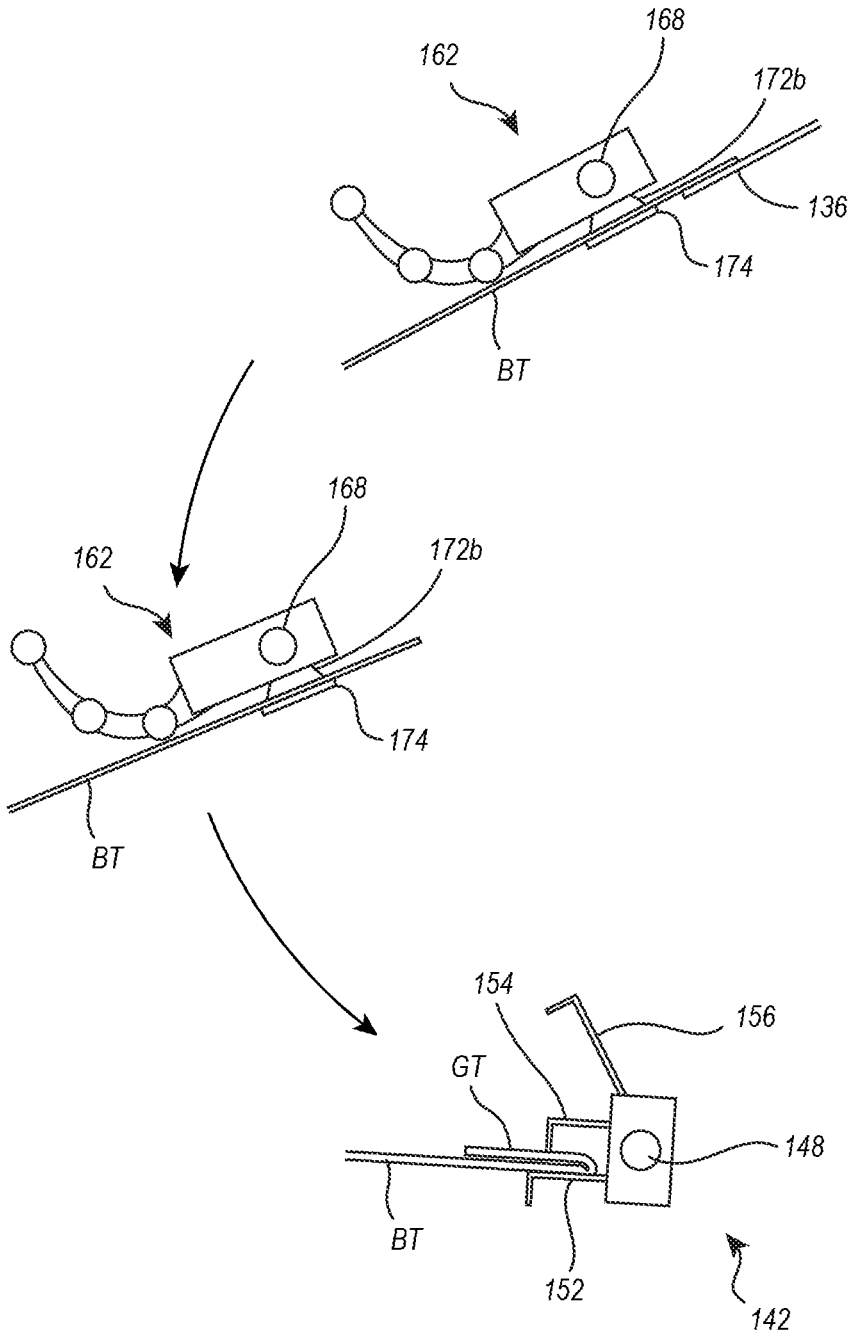
FIGS. 12A-12D illustrate the attachment head of FIG. 8 interacting with a box template.

Once the box template BT has been fed out of the converter assembly 112 and the attachment head 162 has engaged the second end of the box template BT (e.g., via attachment mechanism 172*a* and/or 172*b*), the attachment assembly 116 can move the second end of the box template BT into engagement with the first end thereof. For instance, the upper portion of FIG. 12A illustrates the attachment head 162 engaged with the second end of the box template BT adjacent to the outfeed plate 136. From there, the attachment head 162 can move vertically and/or horizontally relative to the converter assembly 112 in order to bring the second end of the box template BT into engagement with the first end thereof. As illustrated in FIG. 12A, for example, the attachment head 162 may move the box template BT vertically as well as horizontally. As discussed above, the horizontal and/or vertical movement of the attachment head 162 can be accomplished via the movement of the first and/or second sub-frames 158, 160. Additionally, the attachment head 162 can rotate about the shaft 168 to reorient the second end of the box template BT as it moves the second end of the box template BT toward the first end thereof.

Figure 12B:
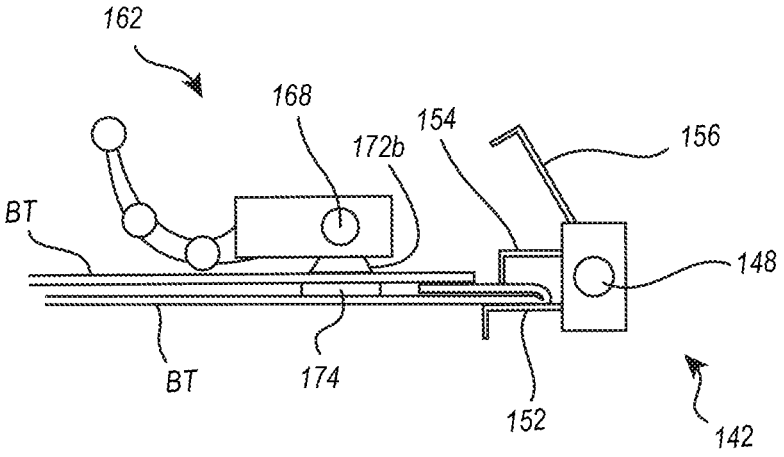

As illustrated in FIG. 12B, the attachment head 162 can bring the second end of the box template BT into engagement with the first end the box template BT such that the two ends of the box template BT are generally parallel to one another. In some embodiments, the attachment head 162 can align the edge of the second end of the box template BT against the first clamp 154 of the fold head 142. As can be seen in FIG. 12B, due to the position of the first clamp 154 on top of part of the glue tab GT, the second end of the box template BT does not entirely cover the glue tab GT.

Figure 12C:
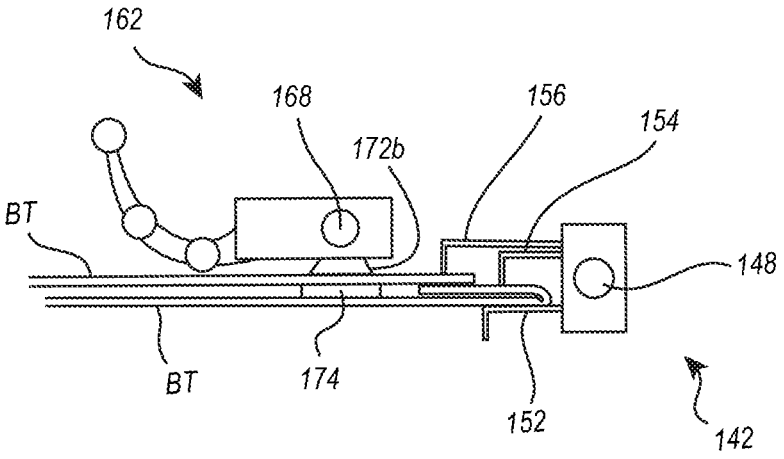

With the second end of the box template BT so positioned on top of the first end of the box template BT, the second clamp 156 of the fold head 142 can move from the open position shown in FIG. 12B to the closed position shown in FIG. 12C. Moving the second clamp 156 to the closed position compresses the second end of the box template BT, the glue tab GT, and the glue that was applied to the glue tab GT by the gluing device 157 between the second clamp 156 and the fold plate 152, as shown in FIG. 12C. Such compression helps to ensure that the second end of the box template BT and the glue tab GT are secured together by the glue.

Once the two ends of the box template BT are secured together, the first and second clamps 154, 156 are released. The attachment head 162 can also release the box template BT to allow the box template BT to be removed from the box forming machine 108. In some embodiments, once the first and second clamps 154, 156 are released, the attachment head 162 can move the box template BT away from the fold head 142 and to a position where the box template BT can be readily removed from the box forming machine 108. For instance, as shown in FIG. 12D, the attachment head 162 can rotate about shaft 168 and move (via movement of sub-frames 158, 160) so as to position the box template BT near an exit point from the box forming machine 108.

Figure 12D:
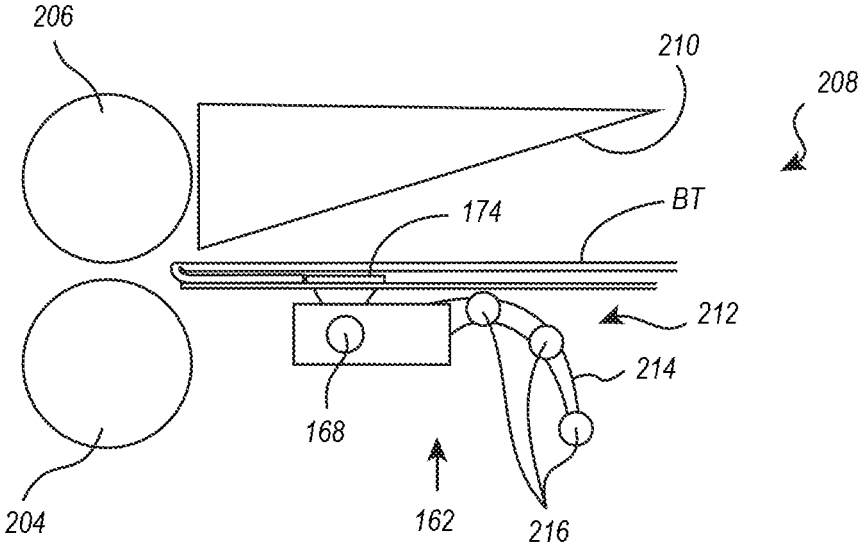

A comparison between FIGS. 12C and 12D shows that the attachment head 162 has rotated about 180 degrees after the fold head 142 releases the box template BT. In other embodiments, the attachment head 162 may rotate about 90 degrees after the fold head 142 releases the box template BT. In some embodiments, prior to rotation of the attachment head 162, the box template BT may be oriented generally parallel to the outfeed plate 136. After rotation of the attachment head 162, the box template BT may be oriented generally perpendicular to the outfeed plate 136.

In any event, after or during rotation of the attachment head 162, the attachment head 162 may then move the box template BT towards an exit point (e.g., an opening, slot, or the like in the machine 108) through which the box template BT can be fed out of or retrieved from the box forming machine 108. During such movement, one or more of the attachment mechanisms 172 may continue to secure the box template BT to the attachment head 162, such that the box template BT is rotated and moved with the attachment head 162.

In some embodiments, as shown in FIG. 12D, one or more sets of opposing rollers 204, 206 may be positioned adjacent to the exit point of the machine 108. The opposing rollers 204, 206 may be activated to feed the box template BT out of the machine 108. For instance, the rollers 204 may be advanced towards the rollers 206 and rotated to feed the box template BT out of the machine 108. In other embodiments, the rollers 206 may advance towards the rollers 204, or the rollers 204 and rollers 206 may advance towards each other. In any case, one or more of the rollers 204, 206 may be active rollers (e.g., rotated by a motor, etc.) that advance the box template BT out of the box forming machine 108.

In some instance, even after the ends of the box template BT have been secured together, the box template BT may not lie flat. For instance, panels of the box template BT may spread apart from one another. This may be caused by folds in the sheet material 104 used to form the box template BT. As noted above, the sheet material 104 is folded into stacks in bales 102 before being used to form the box templates BT. While the folds formed in the sheet material 104 may allow the sheet material 104 to be stacked into bales 102, such folds can also cause the formed box templates BT to not want to lie flat.

To flatten the box templates BT before feeding them through the rollers 204, 206, the box templates BT may be advanced through an outfeed guide channel 208, as illustrated in FIG. 12D. The outfeed guide channel 208 may gradually flatten the box template BT such that additional creases are not formed in the box template BT as it is fed through the rollers 204, 206.

In the illustrated embodiment, the outfeed guide channel 208 includes an angled plate 210. The angled plate 210 is positioned opposite the attachment head 162 (when the attachment head 162 is rotated and moved towards the exit point of the machine 108, as shown in FIG. 12D) such that the box template BT is positioned between the attachment head 162 and the angled plate 210. The angled plate 210 is angled towards the attachment head 162, such that advancement of the box template BT along the angled plate 210 causes the box template BT to be feed towards the attachment head 162.

The outfeed guide channel 208 may also include one or more guides 212. In the illustrated embodiment, the guides are mounted on the attachment head 162 such that the guides 212 move with the attachment head 162. Each guide 212 includes an arcuate or angled frame 214. The frame 214 is arranged such that the frame 214 and the angled plate 210 cooperate to form a tapering channel. In other words, the angled plate 210 and the frame 214 are shaped and oriented so that a channel formed therebetween gradual tapers. The tapered channel formed by the angled plate 210 and the frame 214 gradually flattens the box templates BT as the box templates BT advanced therebetween and out of the exit point of the machine 108.

In some embodiments, the angled plate 210 and/or frame 214 may include one or more wheels to assist with the advancement of the box template BT through the tapered channel. For instance, FIG. 12D shows wheels 216 mounted on the frame 214. The wheels 216 can rotate to reduce the friction between the frame 214 and the box templates BT as the box template BT is advanced out of the box forming machine 108.

Once the rollers 204, 206 engage the box template BT, the attachment head 162 can release the box template BT. In particular, the attachment mechanism(s) 172 may disengage the box template BT, thereby allowing the rollers 204, 206 to advance the box template BT out of the machine 108.

Attention is now directed to FIG. 13A-13I, which illustrate portions of an alternative embodiment of a box forming machine 108*a*. The box forming machine 108*a* can be similar or identical to the box forming machine 108 in many respects. Accordingly, the following description of the box forming machine 108*a* will focus primarily on the features that are different from the box forming machine 108. It will be appreciated however that the various features of the box forming machines 108, 108*a* may be interchanged with one another.

Figure 13A:
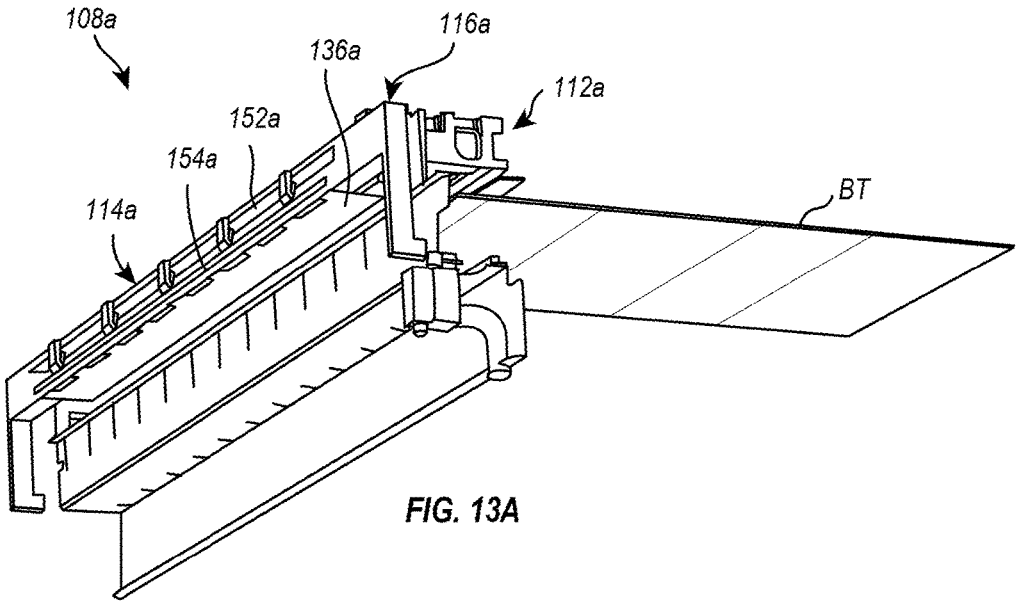
FIGS. 13A-13I illustrate another embodiment of a box forming machine interacting with a box template.
Figure 13B:
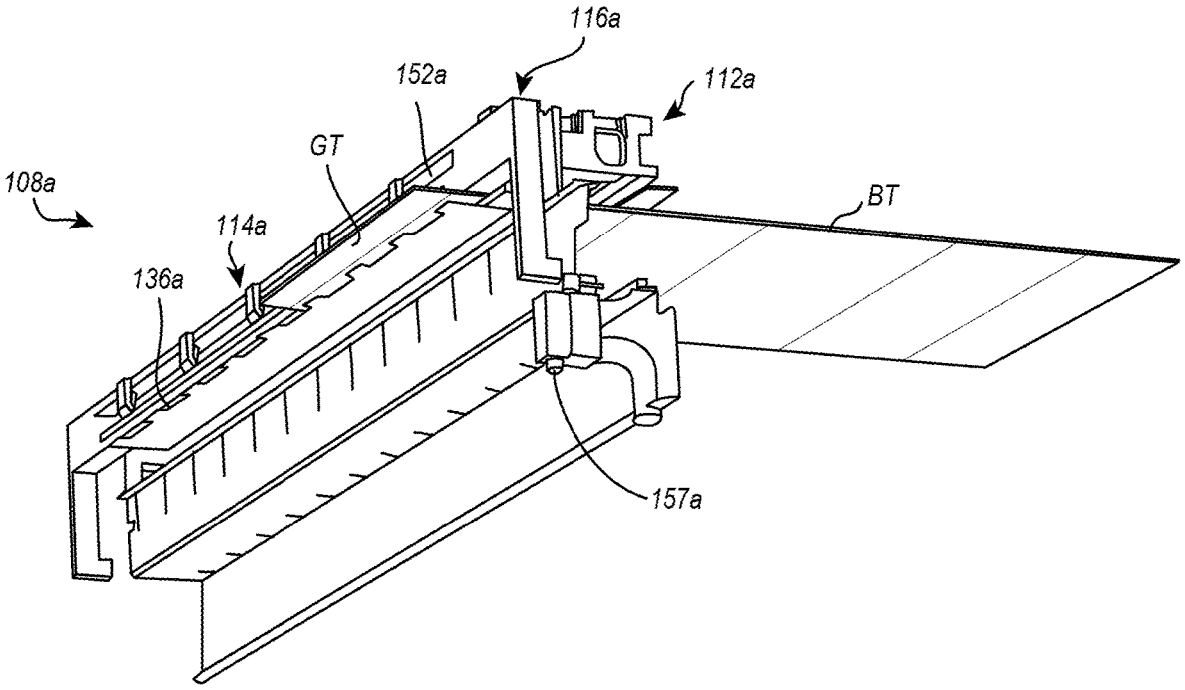

As can be seen in FIG. 13A-13I, box forming machine 108*a* includes a converter assembly 112*a*, a fold assembly 114*a*, and an attachment assembly 116*a*. After the converter assembly 112*a* performs the one or more conversion functions on the fanfold material to transform it into a box template BT, the box template BT is fed out of the converter assembly 112*a* adjacent to the outfeed plate 136*a*. As shown in FIG. 13B, the box template BT is fed out of the converter assembly 112*a* until a crease is aligned with the edge of the outfeed plate 136*a*.

Figure 13C:
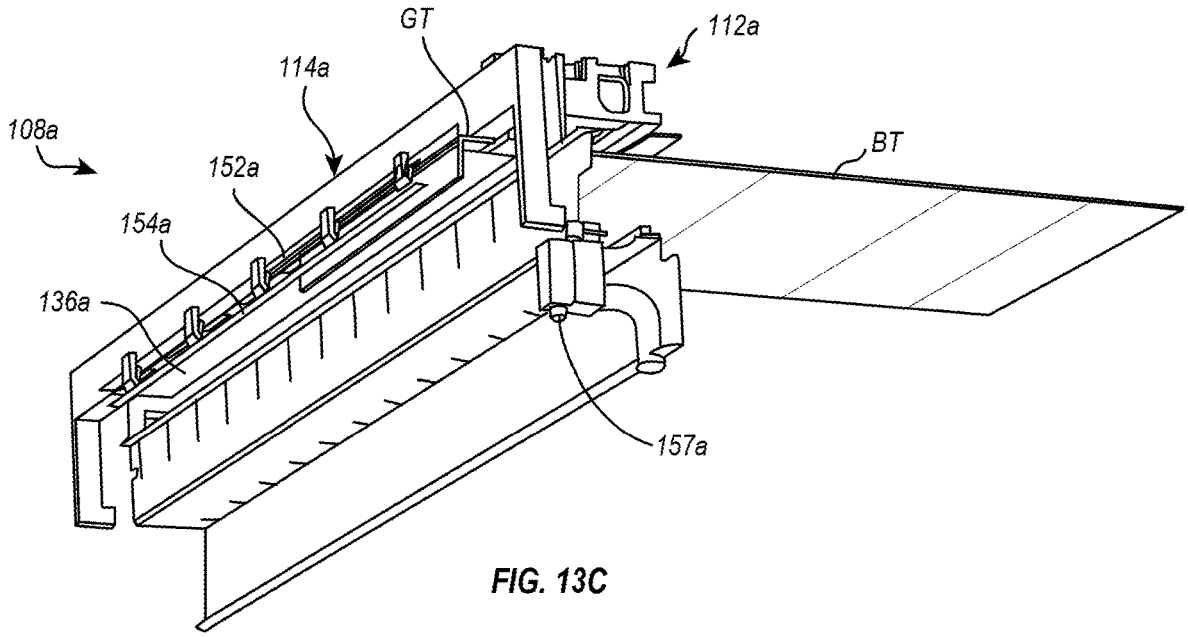

Once the glue tab GT crease is aligned with the edge of the outfeed plate 136*a*, the fold assembly 114*a* engages the box template BT to fold the glue tab GT relative to the rest of the box template BT. For instance, as shown in FIG. 13C, the fold assembly 114*a* can move vertically and/or horizontally to engage the glue tab GT. More specifically, as shown in FIGS. 13C-13D, a first clamp 154*a* of the fold assembly 114*a* can engage the glue tab GT in order to fold the glue tab GT around the outfeed plate 136*a*.

Figure 13D:
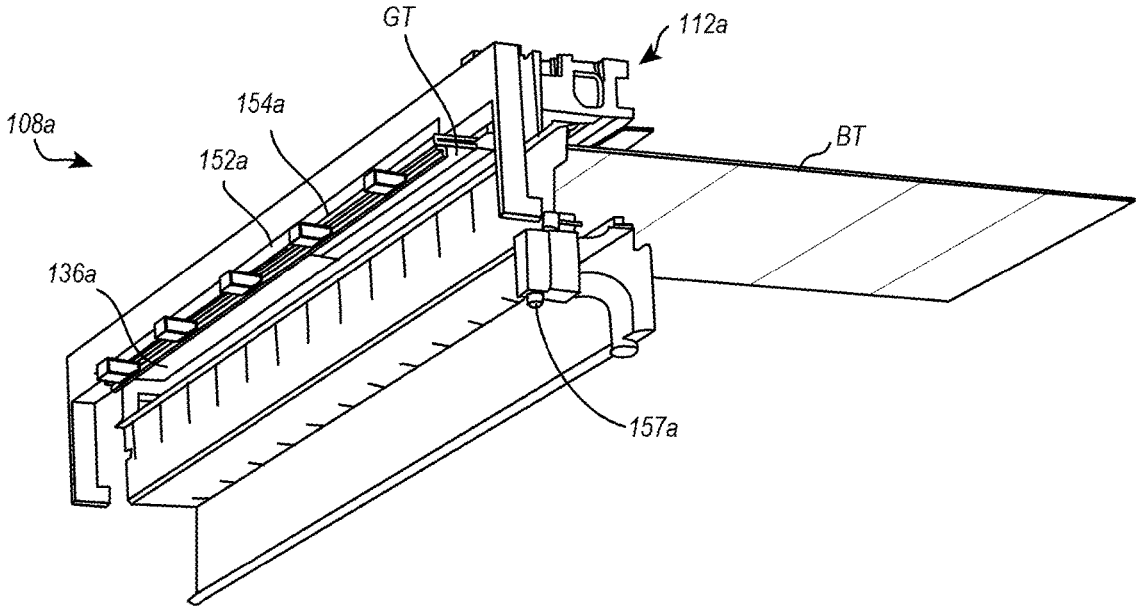
Figure 13E:
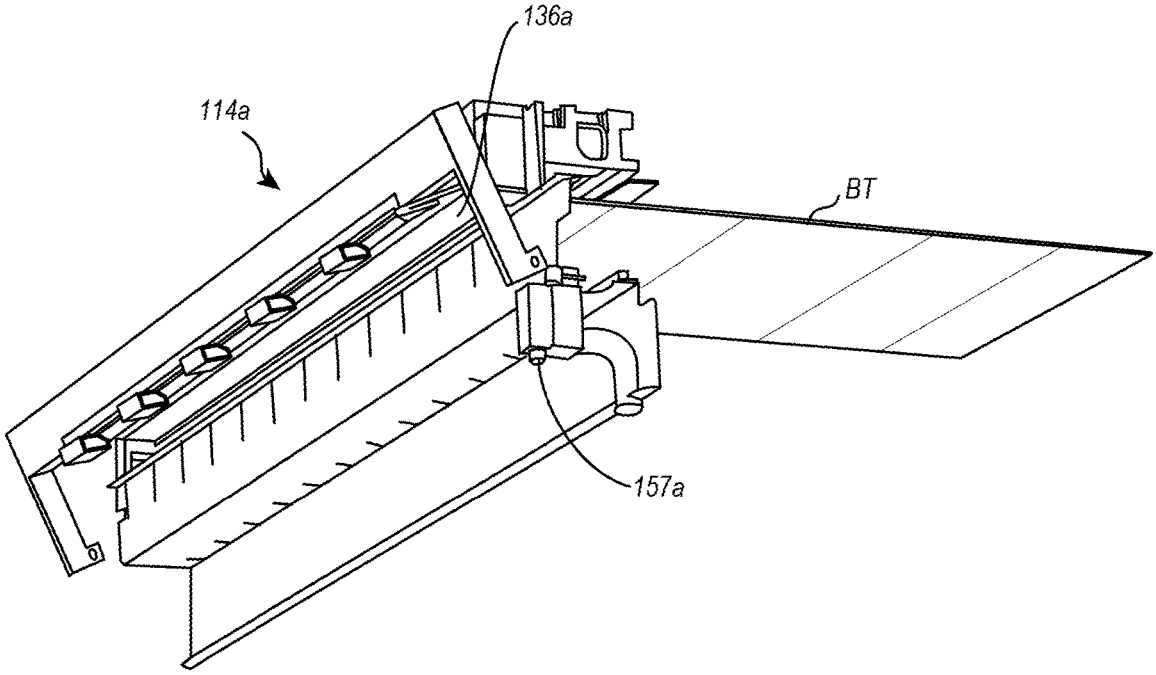
Figure 13F:
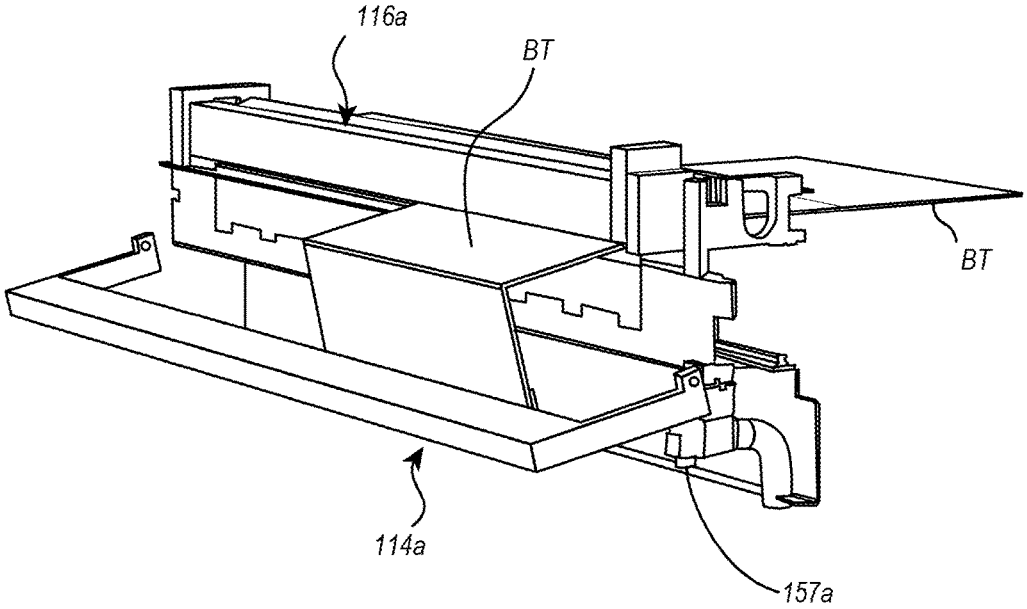
Figure 13G:
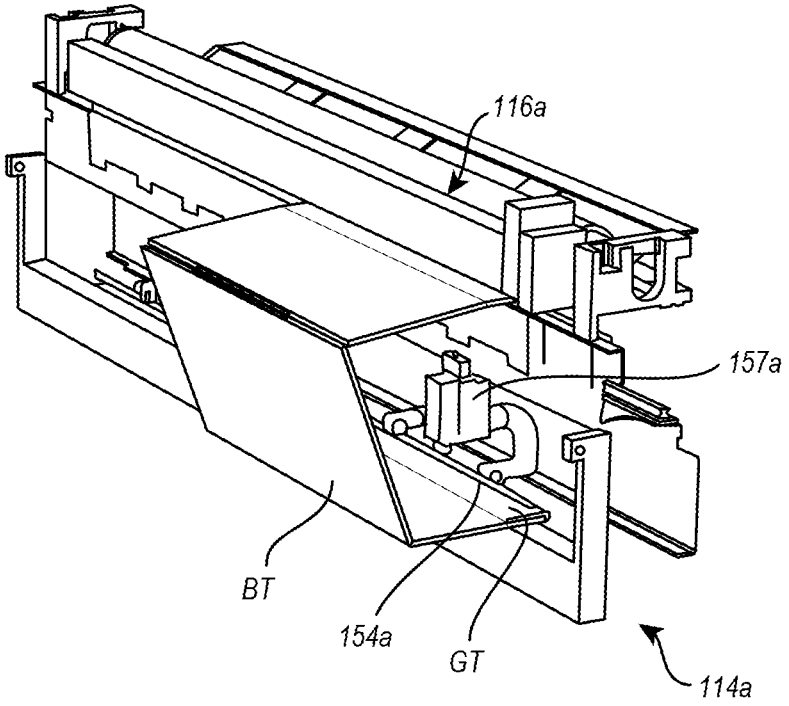

The folded end of the box template BT can be compressed between the first clamp 154*a* and the fold plate 152*a*, as shown in FIG. 13D. As shown in FIGS. 13E-13G, the fold assembly 114*a* can then move away from the converter assembly 112*a*. In the illustrated embodiment, the fold assembly 114*a* can pivot about a pivot axis. As the fold assembly 114*a* moves, the clamping force applied to the folded end of the box template BT (i.e., by the fold plate 152*a* and the first clamp 154*a*) causes the first end of the box template BT to move and be reoriented with the fold assembly 114*a*.

A comparison between FIGS. 13D and 13G, for instance, illustrates that the fold assembly 114*a* can move and reorient the first end the box template from a first position and orientation adjacent to the converter assembly 112*a* to a second position and orientation adjacent to a gluing device 157*a*. As with the previous embodiment, once the first end of the box template BT is in the first position and orientation, the glue tab GT is facing generally downward. In the second position and orientation, the glue tab GT is facing generally upward. Once the first end of the box template BT is moved and reoriented to the second position and orientation, the gluing device 157*a* can apply glue to the glue tab GT, as shown in FIG. 13G.

While the fold assembly 114*a* is moving the first end of the box template BT and the gluing device 157*a* is applying glue to the glue tab GT, the box template BT continues to be fed out of the converter assembly 112*a*, as can be seen in FIGS. 13C-13G. The movement of the first end of the box template BT and the continual feeding out of the box template BT causes the box template BT to fold in half as shown in the Figures.

Figure 13H:
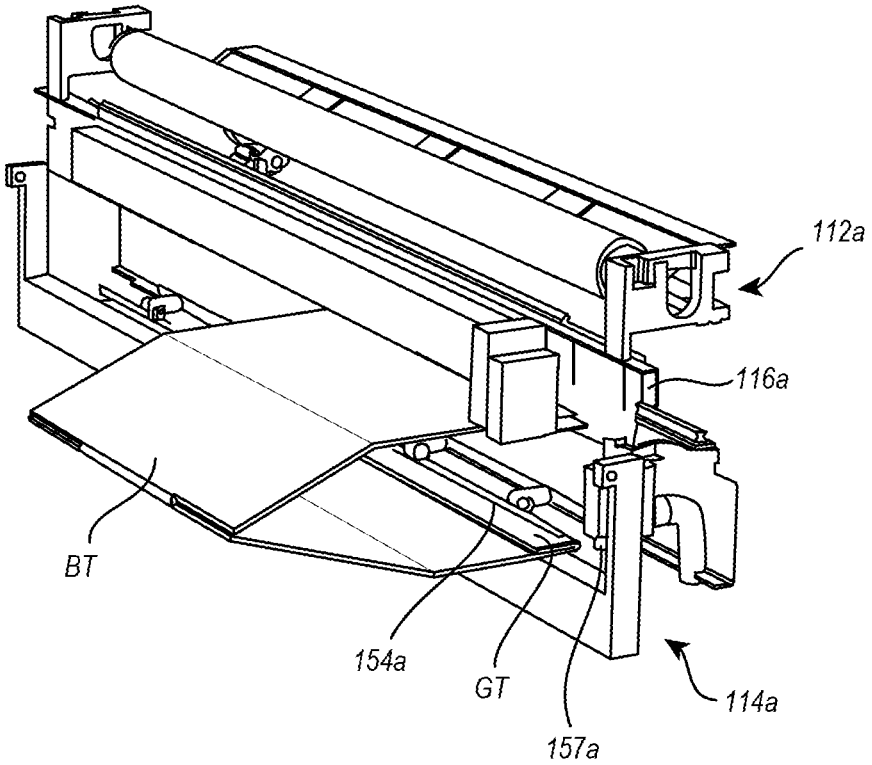
Figure 13I:
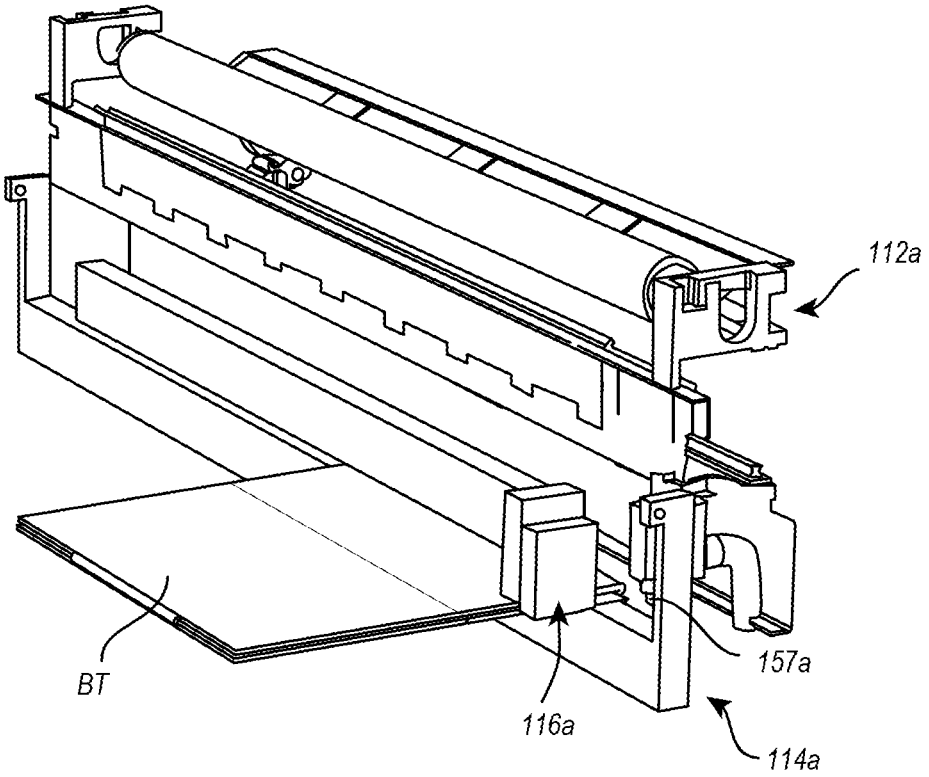

When the second end of the box template BT is fed out of the converter assembly 112*a*, the attachment assembly 116*a* engages the second end the box template BT and can move it toward the first end the box template BT. For example, FIGS. 13H-13I illustrate the attachment assembly 116*a* moving the second end of the box template BT from the outfeed side of the converter assembly 112*a* toward and into contact with the glue tab GT. In some embodiments, the attachment assembly 116*a* can press the second end of the box template BT against the glue tab GT (with the glue therebetween) to secure the two ends of the box template BT together. In other embodiments, similar to the embodiment described above, the fold assembly 114*a* may include a second clamp that presses the second end of the box template BT and the glue tab GT together with the glue therebetween.

Once the two ends of the box template BT are joined together, the box template BT can be removed from the box forming machine 108*a*. For instance, the fold assembly 114*a* and the attachment assembly 116*a* can release their holds on the box template BT. Thereafter, the box template BT can be freely removed from the box for machine 108*a*.

In light of the foregoing, it will be appreciated that the present disclosure relates to box forming machines that can perform one or more conversion functions on the sheet material to convert the sheet material into box templates. In addition, the box forming machines of the present disclosure can engage a first end of a box template and move the first end of the box template to a predetermined location. When engaging the first end the box template, the box forming machine may fold a first portion of the box template (e.g., a glue tab) relative to a second portion of the box template. In moving the first end the box template to the predetermined location, the box forming machine can reorient the first end of the box template to a desired orientation. With the first end the box template in the predetermined location and the desired orientation, glue can be applied to the first end the box template.

The box forming machines of the present disclosure can also engage the second end of the box template and move the second end of the box template into engagement with the first end the box template. In moving the second end the box template into engagement with the first end the box template, the box forming machine can reorient the second end the box template to a desired orientation (e.g., parallel to the first end of the box template). In some embodiments, the box forming machines can compress the first and second ends of the box template together with glue therebetween in order to secure the first and second ends together. Once the first and second ends of the box template have been secured together, the box forming machine can either release the box template or move the box template to a desired location where it can be removed from the box forming machine.

The embodiments described above include folding the first end the box template and then bringing the second end of the box template into engagement with the folded end the box template. It will be appreciated, however, that this is merely exemplary. In other embodiments, for instance, box forming machines may engage the first end of the box template without folding a portion thereof. The first end the box template may then be moved and/or reoriented to a predetermined and desired position and location. The box forming machine may then engage the second end the box template. Engaging the second end of the box template may include folding a first portion (e.g., a glue tab) relative to another portion of the box template. The box forming machine may then move the folded second end the box template into engagement with the first end the box template to secure the first and second ends together.

The present invention may be embodied in other specific forms without departing from its spirit or essential characteristics. The described embodiments are to be considered in all the tough to respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A box forming machine comprising:

a converter assembly that is configured to perform one or more conversion functions on a sheet material to convert the sheet material to a box template;

a fold assembly that is configured to engage a first end of the box template and move the first end of the box template to a predetermined position, wherein the fold assembly comprises a fold head having a fold plate and a first clamp, wherein the fold plate and the first clamp are configured to selectively hold the first end of the box template; and an attachment assembly that is configured to engage a second end of the box template and move the second end of the box template toward and into engagement with the first end of the box template.

2. The box forming machine of claim 1, wherein the fold head further comprises a second clamp, wherein the fold plate and the second clamp are configured to compress together the first and second ends of the box template once the attachment assembly has moved the second end of the box template into engagement with the first end of the box template.

3. The box forming machine of claim 1, wherein the fold assembly comprises first and second sub-frames that are movably connected together.

4. The box forming machine of claim 3, wherein the fold head is connected to the second sub-frame, wherein the movable nature of the first and second sub-frames enables the fold head to move within an X-Y field to move the first end of the box template to the predetermined position.

5. The box forming machine of claim 4, wherein the fold head is rotatable, wherein rotation of the fold head is configured to reorient the first end of the box template from a first orientation to a second orientation.

6. The box forming machine of claim 1, wherein the fold assembly is configured to fold a glue tab disposed at the first end of the box template onto an adjacent portion of the box template.

7. The box forming machine of claim 1, wherein the attachment assembly comprises an attachment head having one or more attachment mechanisms, wherein the one or more attachment mechanisms are configured to selectively hold the second end of the box template.

8. The box forming machine of claim 7, wherein the one or more attachment mechanisms comprise one or more clamps that can be selectively moved into engagement with the second end of the box template to selectively hold the second end of the box template.

9. The box forming machine of claim 7, wherein the one or more attachment mechanisms comprise one or more vacuum heads that can be selectively activated to selectively hold the second end of the box template.

10. The box forming machine of claim 9, wherein the one or more vacuum heads comprise at least two vacuum heads that are offset from one another.

11. The box forming machine of claim 7, wherein the attachment head further comprises one or more guides.

12. The box forming machine of claim 11, wherein the one or more guides comprise one or more arcuate or angled frames configured to flatten and guide a box template out of the box forming machine.

13. The box forming machine of claim 12, wherein the one or more arcuate or angled frames comprise one or more wheels mounted thereon.

14. The box forming machine of claim 1, wherein the attachment assembly comprises first and second sub-frames that are movably connected together.

15. The box forming machine of claim 14, wherein the second sub-frame is selectively extendable or retractable.

16. The box forming machine of claim 14, wherein the attachment assembly further comprises an attachment head connected to the second sub-frame, wherein the movable nature of the first and second sub-frames enables the attachment head to move within an X-Y field to move the second end of the box template toward the first end of the box template.

17. The box forming machine of claim 16, wherein the attachment head is rotatable, wherein rotation of the attachment head is configured to reorient the second end of the box template from a first orientation to a second orientation.

18. The box forming machine of claim 17, wherein the attachment head is configured to move the box template to an exit point of the box forming machine.

19. The box forming machine of claim 17, further comprising an angled plate disposed adjacent to the exit point, the angled plate being configured to flatten and guide the box template out of the box forming machine.

20. A box forming machine comprising:

a frame;

a converter assembly mounted on the frame, the converter assembly being configured to perform one or more conversion functions on a sheet material to convert the sheet material to a box template;

a fold assembly that is configured to engage a first end of the box template and move the first end of the box template to a predetermined position, wherein the fold assembly comprises a fold head having a fold plate and a first clamp configured to selectively clamp onto the first end of the box template, wherein the fold head is movably connected to the frame to enable movement of the first end of the box template to the predetermined position; and an attachment assembly that is configured to engage a second end of the box template and move the second end of the box template toward and into engagement with the first end of the box template, wherein the attachment assembly comprises an attachment head having one or more attachment mechanisms for selectively attaching to the second end of the box template, wherein the attachment head is movably connected to the frame to enable movement of the second end of the box template ward and into engagement with the first end of the box template.

21. The box forming machine of claim 20, wherein the attachment head is movably connected to the frame via one or more movable sub-frames.

22. The box forming machine of claim 20, wherein the fold head is movably connected to the frame via one or more movable sub-frames.

23. The box forming machine of claim 20, wherein the fold head is pivotally connected to the frame.

24. The box forming machine of claim 20, wherein the fold assembly is configured to fold a glue tab disposed at the first end of the box template about an outfeed plate of the converter assembly.

25. The box forming machine of claim 20, further comprising a gluing device that is configured to apply glue to the first end of the box template after the first end of the box template is moved to the predetermined position.

26. A box forming machine comprising:

a converter assembly that is configured to perform one or more conversion functions on a sheet material to convert the sheet material to a box template;

a fold assembly that is configured to engage a first end of the box template and move the first end of the box template to a predetermined position; and an attachment assembly that is configured to engage a second end of the box template and move the second end of the box template toward and into engagement with the first end of the box template, wherein the attachment assembly comprises an attachment head having one or more attachment mechanisms, wherein the one or more attachment mechanisms are configured to selectively hold the second end of the box template.

27. The box forming machine of claim 26, wherein the one or more attachment mechanisms comprise one or more clamps that can be selectively moved into engagement with the second end of the box template to selectively hold the second end of the box template.

28. The box forming machine of claim 26, wherein the one or more attachment mechanisms comprise one or more vacuum heads that can be selectively activated to selectively hold the second end of the box template.

29. The box forming machine of claim 28, wherein the one or more vacuum heads comprise at least two vacuum heads that are offset from one another.

30. The box forming machine of claim 26, wherein the attachment head further comprises one or more guides.

31. The box forming machine of claim 30, wherein the one or more guides comprise one or more arcuate or angled frames configured to flatten and guide a box template out of the box forming machine.

32. The box forming machine of claim 31, wherein the one or more arcuate or angled frames comprise one or more wheels mounted thereon.

33. The box forming machine of claim 26, wherein the fold assembly comprises a fold head having a fold plate and a first clamp, wherein the fold plate and the first clamp are configured to selectively hold the first end of the box template.

34. The box forming machine of claim 33, wherein the fold head further comprises a second clamp, wherein the fold plate and the second clamp are configured to compress together the first and second ends of the box template once the attachment assembly has moved the second end of the box template into engagement with the first end of the box template.

35. The box forming machine of claim 26, wherein the fold assembly comprises first and second sub-frames that are movably connected together.

36. The box forming machine of claim 35, wherein the fold assembly further comprises a fold head connected to the second sub-frame, wherein the movable nature of the first and second sub-frames enables the fold head to move within an X-Y field to move the first end of the box template to the predetermined position.

37. The box forming machine of claim 36, wherein the fold head is rotatable, wherein rotation of the fold head is configured to reorient the first end of the box template from a first orientation to a second orientation.

38. The box forming machine of claim 26, wherein the fold assembly is configured to fold a glue tab disposed at the first end of the box template onto an adjacent portion of the box template.

39. The box forming machine of claim 26, wherein the attachment assembly comprises first and second sub-frames that are movably connected together.

40. The box forming machine of claim 39, wherein the second sub-frame is selectively extendable or retractable.

41. The box forming machine of claim 39, wherein the attachment head is connected to the second sub-frame, wherein the movable nature of the first and second sub-frames enables the attachment head to move within an X-Y field to move the second end of the box template toward the first end of the box template.

42. The box forming machine of claim 41, wherein the attachment head is rotatable, wherein rotation of the attachment head is configured to reorient the second end of the box template from a first orientation to a second orientation.

43. The box forming machine of claim 42, wherein the attachment head is configured to move the box template to an exit point of the box forming machine.

44. The box forming machine of claim 42, further comprising an angled plate disposed adjacent to the exit point, the angled plate being configured to flatten and guide the box template out of the box forming machine.

* * * * *